US007941873B2

(12) United States Patent
Nagely et al.

(10) Patent No.: US 7,941,873 B2
(45) Date of Patent: May 17, 2011

(54) PROTECTIVE HELMET WITH CERVICAL SPINE PROTECTION AND ADDITIONAL BRAIN PROTECTION

(75) Inventors: Scott W. Nagely, Kansas City, MO (US); Ian D Kovacevich, Charlotte, NC (US); Christopher R Hoy, Charlotte, NC (US)

(73) Assignee: Scott W. Nagely, Kansas City, MO (US)

( * ) Notice: Subject to any disclaimer, the term of this patent is extended or adjusted under 35 U.S.C. 154(b) by 287 days.

(21) Appl. No.: 12/143,589

(22) Filed: Jun. 20, 2008

(65) Prior Publication Data

US 2008/0313791 A1 Dec. 25, 2008

Related U.S. Application Data

(63) Continuation-in-part of application No. 11/603,510, filed on Nov. 22, 2006, now Pat. No. 7,430,767.

(60) Provisional application No. 60/945,434, filed on Jun. 21, 2007, provisional application No. 60/739,864, filed on Nov. 23, 2005.

(51) Int. Cl.
*A63B 71/10* (2006.01)

(52) U.S. Cl. ..... 2/425; 2/468

(58) Field of Classification Search ..... 2/416, 421, 2/422, 425, 461, 462, 468; 602/16–18
See application file for complete search history.

(56) References Cited

U.S. PATENT DOCUMENTS 3,134,106 A 5/1964 Shaffer et al.
3,671,974 A 6/1972 Sims
3,818,509 A 6/1974 Romo et al.
3,849,801 A 11/1974 Holt et al.
3,873,996 A 4/1975 Varteressian
3,925,822 A 12/1975 Sawyer
5,029,341 A 7/1991 Wingo, Jr.
5,123,408 A 6/1992 Gaines
5,261,125 A 11/1993 Cartwright et al.
5,272,770 A 12/1993 Allen et al.
5,287,562 A 2/1994 Rush, III
5,295,271 A 3/1994 Butterfield et al.
5,313,670 A 5/1994 Archer, III
5,353,437 A 10/1994 Field et al.
5,371,905 A 12/1994 Keim
5,444,870 A 8/1995 Pinsen
5,493,736 A 2/1996 Allison
5,517,699 A 5/1996 Abraham, II
5,566,399 A 10/1996 Cartwright et al.
5,581,816 A 12/1996 Davis
5,715,541 A 2/1998 Landau
5,930,843 A 8/1999 Kelly
6,006,368 A 12/1999 Phillips
6,052,835 A 4/2000 O'Shea
6,385,781 B1 5/2002 Rose et al.
6,401,260 B1 6/2002 Porth
6,481,026 B1 11/2002 McIntosh
6,560,789 B2 5/2003 Whalen et al.

(Continued)

*Primary Examiner* — Danny Worrell
(74) *Attorney, Agent, or Firm* — Hovey Williams LLP

(57) ABSTRACT

A protective helmet, which includes a motion restrictor device, is disclosed which has at least one strut member associated with the helmet and a harness assembly, and the at least one strut member includes a locking assembly associated with the strut member, which upon a predetermined force being sensed by a force sensor or a predetermined amount of or rate of acceleration being sensed by an acceleration sensor, stops substantially all relative motion between the ends of the strut member and the predetermined force is substantially transferred from the helmet to the harness assembly.

22 Claims, 17 Drawing Sheets

U.S. PATENT DOCUMENTS

| | | | | |
|---|---|---|---|---|
| 6,874,170 | B1 | 4/2005 | Aaron | |
| 6,934,971 | B2 | 8/2005 | Ide et al. | |
| 6,968,576 | B2 | 11/2005 | McNeil et al. | |
| 7,120,941 | B2 | 10/2006 | Glaser | |
| 7,430,767 | B2 * | 10/2008 | Nagely | 2/425 |
| 2002/0100109 | A1 | 8/2002 | Hoop | |
| 2003/0088906 | A1 | 5/2003 | Baker | |
| 2004/0194194 | A1 | 10/2004 | McNeil et al. | |
| 2004/0255368 | A1 | 12/2004 | Baker | |
| 2005/0034222 | A1 | 2/2005 | Durocher | |

* cited by examiner

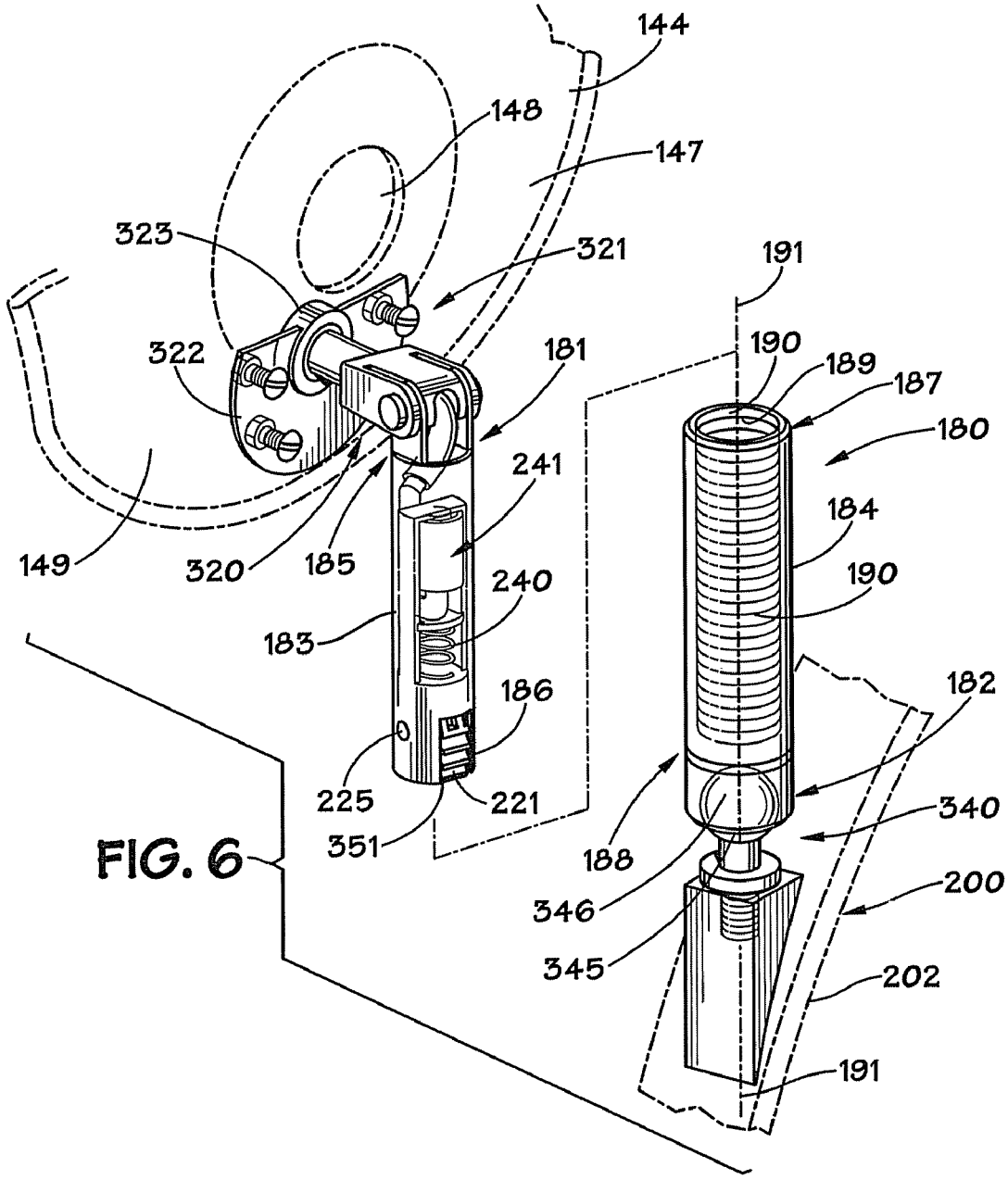
FIG. 6
FIG. 11
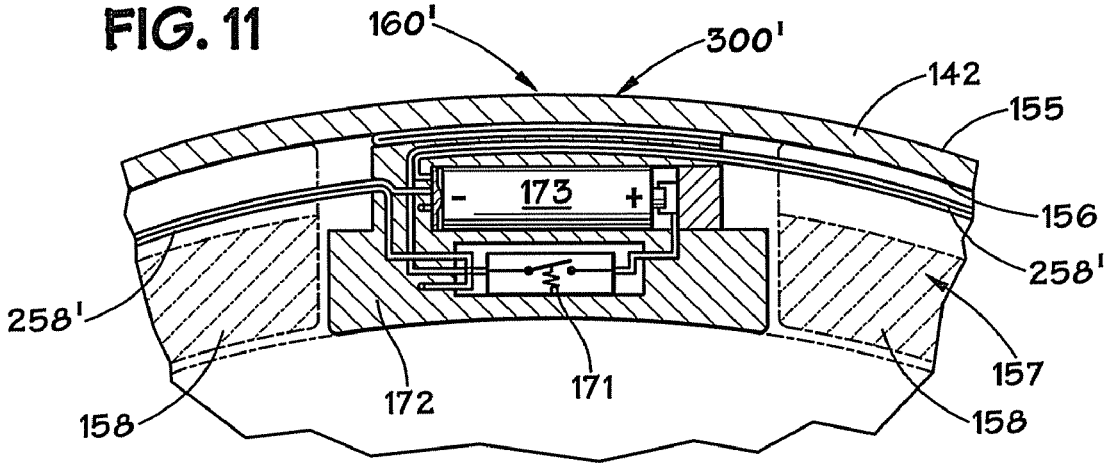

PROTECTIVE HELMET WITH CERVICAL SPINE PROTECTION AND ADDITIONAL BRAIN PROTECTION

RELATED APPLICATIONS

This application claims the benefit and priority of U.S. Provisional Patent Application Ser. No. 60/945,434 filed Jun. 21, 2007, and entitled Protective Helmet With Cervical Spine Protection and Additional Brain Protection and is further a continuation-in-part of patent application Ser. No. 11/603,510 filed on Nov. 22, 2006, now Patent No. 7,430,767, which claims the benefit of U.S. Provisional Application No. 60/739,864, filed on Nov. 23, 2005, now abandoned.

BACKGROUND OF THE INVENTION

1. Field of the Invention

The invention relates generally to a protective helmet and a motion restrictor device adapted for use with a protective helmet, and in particular, but not limited to a football helmet.

2. Description of the Related Art

Various activities, such as snowmobile riding, lacrosse, hockey, motocross, supercross, motorcycle riding, automobile racing, go-cart riding, automobile racing, snowboarding, snowskiing, aircraft flying, bicycle riding, pole vaulting and contact sports and in particular the sport of football, require the use of helmets to attempt to protect participants from injury to their heads due to impact forces that may be sustained during such activities. Various types of helmets have been in use in the sport of football, ever since individuals began wearing helmets to attempt to protect their heads many years ago. Typically, these helmets have included: an outer shell, generally made of an appropriate plastic material, having the requisite strength and durability characteristics to enable them to be used in the sport of football; some type of shock absorbing liner within the shell; a face guard; and a chin protector, or chin strap, that fits snugly about the chin of the wearer of the helmet, in order to secure the helmet to the wearer's head, as are all known in the art.

In an attempt to minimize cervical spine injuries, such as football-related cervical spine injuries, various protective helmets, such as football helmets have been suggested which include some structure to secure the helmet to the shoulder pads worn by the football player. In general, most of the previously proposed football helmets suffer from various disadvantages resulting from: the bulkiness and/or unwieldy nature of the components utilized with the helmet; inadequate support of the helmet with respect to the shoulder pads; and not having the ability to substantially restrict, or prevent, relative motion between the helmet and the player's shoulders. In general, the cervical spine injuries suffered by football players are caused by axial loading of the cervical spine, or the application of a compressive force upon the spine in a direction generally parallel to the longitudinal axis of the football player's spine. Thus, the rules of football were modified in 1976 by the National Collegiate Athletic Association and the National Federation of State High School Athletic Associations to ban "spearing" of an opposing player by a player utilizing his football helmet. Those rule changes have reduced the number of cervical spine injuries in the sport of football, but every year there are still a number of these types of injuries, which may have a catastrophic impact upon the player suffering such an injury. The football player typically goes from being an active, healthy teenager or young adult to a quadriplegic, dependent upon others for even the most basic of human bodily functions. These former players may endure a life of limited mobility, potentially limited experiences, recurrent infections, and a potentially shortened life span. Millions of dollars in health care related costs are expended in treatment and care of these individuals, and in addition each affected family suffers an emotional and psychological toll resulting from such injury.

While the intentional offensive use of a football helmet to butt or spear the player's opponent is many times the cause of a cervical spine injury, many of these injuries resulting from an axial load upon the player's spine, occur when a player is tackling an opponent with his head unintentionally lowered. While tackling techniques are widely taught in high schools across the nation, a player's natural reflex is to drop his head at the point of contact, rather than to watch the collision occur a few inches from his face as the opponent's body may strike the tackler's facemask.

The normal lordotic curve of the cervical spine is believed to be a protective mechanism, because the cervical spine is able to dissipate a blow to the head by hyper-extending without injury. It is believed that when the lordotic curve is straightened, as may occur when a football player's head is lowered, this potential protective mechanism may be lost. If the axial load, or force, upon the top, or crown, of a player's head is large enough, the disruption of the ligaments of the cervical spine, or even a burst fracture of the cervical vertebrae may occur as the energy is dissipated. These injuries may result in severe injury of the very fragile nerve tissue of the spinal cord, and paralysis may often result from the injury.

While it is the desire and goal that a football helmet, and other types of protective helmets, prevent injuries from occurring, it should be noted that as to the helmet of the present invention, due to the nature of the sport of football in particular, no protective equipment or helmet can completely, totally prevent injuries to those individuals playing the sport of football or wearing any protective helmet. It should be further noted that no protective equipment can completely prevent injuries to a player, if the football player uses his football helmet in an improper manner, such as to butt, ram, or spear an opposing player, which is in violation of the rules of football. Improper use of a helmet to butt, ram, or spear an opposing player can result in severe head and/or neck injuries, paralysis, or death to the football player, as well as possible injury to the football player's opponent. No football helmet, or protective helmet, such as that of the present invention, can prevent head, chin, or neck injuries a football player might receive while participating in the sport of football. The helmet of the present invention is believed to offer protection to football players, but it is believed that no helmet can, or will ever, totally and completely prevent head, neck, or spine injuries to football players.

The protective helmet of the present invention and motion restrictor device for use with a protective helmet, when compared to previously proposed protective helmets and motion restrictor devices have the advantages of: being designed to attempt to protect a wearer of the helmet from injuries caused by an impact force striking the top, or crown, of the helmet and acceleration of the helmet beyond a safe threshold; not being bulky and unwieldy to wear, and difficult to use; provides a substantially complete free range of movement, within normal anatomic limits of head and neck movement, of the helmet until an impact force, beyond a predetermined amount, is applied to the top of the helmet or an acceleration of the helmet greater than a predetermined amount of or rate of acceleration is detected by an acceleration sensor; and, upon sustaining a force equal to, or greater than the predetermined amount, or an acceleration equal to or greater than the predetermined amount of acceleration or rate of acceleration, the motion restrictor device of the helmet locks to substantially prevent relative motion of the helmet with respect to the player wearing the helmet; at all times, even when there is no force on the helmet, hard stops or abutments are in place that limit the range of motion between the first and second ends of the at least one strut member and other abutments are in place that limit the range of motion of the hinging and pivoting connectors that connect the strut members to the helmet and similar abutments are also in place that limit the range of motion of the hinging and pivoting connectors that connect the strut members to the shoulder harness thus limiting the range of motion of the helmet and cervical spine protection device to the normal, non-injurious range of motion of the head and neck of the wearer and help prevent injuries related to hyper-flexion, lateral-flexion, hyper-extension and rotation of the head and neck beyond normal anatomic movement; the acceleration sensor use in the protective helmet also aids in attempting to prevent or reduce the severity of head and brain injury by substantially stopping head and neck movement with respect to the chest, back and shoulders of the individual wearing the protective helmet by locking the motion restrictor device of the helmet when a predetermined amount of acceleration or rate of acceleration of the helmet is exceeded.

SUMMARY OF EMBODIMENTS OF THE INVENTION

The foregoing advantages are believed to have been achieved by the present protective helmet. Some embodiments of the present protective helmet may include: a shell having an upper wall, two side walls, and a back wall; a force sensor disposed adjacent the upper wall of the shell; an acceleration sensor disposed adjacent to the upper wall of the shell, however, the acceleration sensor alternatively can be disposed adjacent to any aspect of the helmet that is associated with the shell of the helmet; at least one strut member having first and second ends, the first end of the at least one strut member associated with one of the walls of the protective helmet and the second end of the at least one strut member is associated with a harness assembly; the at least one strut member permitting relative motion between the first and second ends of the at least one strut member; and a locking assembly associated with the at least one strut member, and the locking assembly, upon a predetermined force being sensed by the force sensor or upon a predetermined acceleration sensed by the acceleration sensor, having a first locked configuration stopping substantially all relative motion between the first and second ends of the at least one strut member, whereby the shell substantially does not move with respect to the at least one strut member and the predetermined force is substantially transferred from the shell, through the at least one strut member, and to the harness assembly. Another feature of an embodiment of the present invention is that the locking assembly has a second, unlocked configuration which permits relative motion between the first and second ends of the at least one strut member, and this unlocked configuration occurs when the predetermined force, being sensed by the force sensor, is removed, or when the rate of acceleration falls below a predetermined rate of acceleration.

Another feature of certain embodiments of the present invention is that the at least one strut member may comprise first and second tubular members, the first tubular member being telescopically received within the second tubular member for relative motion between the first and second tubular members. An additional feature is that the locking assembly may be disposed within the at least one strut member and may include at least one wedge member that is engageable with an interior wall surface of one of the tubular members to substantially prevent relative motion between the first and second tubular members. A further feature is that the locking assembly may be associated with the first tubular member, and the second tubular member may have a plurality of grooves formed in the interior wall surface of the second tubular member, and the at least one wedge member is engageable with at least one of the plurality groups.

Another feature of this aspect of certain embodiments is that an actuation system may be associated with the force sensor and the locking assembly, and the actuation system, upon a predetermined force being sensed by the force sensor, actuates the locking assembly to cause the at least one wedge member to engage the interior wall surface of one of the tubular members. The actuation system may include a hydraulic fluid passageway in fluid communication with the locking assembly, or alternatively, may include an electrical switch in electrical communication with the locking assembly. In addition to or instead of the force sensor, an acceleration sensor may be associated with the actuation system and locking assembly, and the actuation system, upon a predetermined amount of or rate of acceleration, sensed by the acceleration sensor, actuates the locking assembly in each of the at least one strut members to stop substantially all of the telescoping motion of one end relative to the other end of the at least one strut member.

An additional feature is that the first end of the at least one strut member may include a connection assembly connecting the first end of the at least one strut member to one of the walls of the protective helmet, the connection assembly including a rotatable and pivotable connector, whereby the first end of the at least one strut member may both rotate and pivot with respect to the wall of the protective helmet. An additional feature is that the second end of the at least one strut member may include a connection assembly connecting the second end of the at least one strut member to the harness assembly, the connection assembly including a rotatable and pivotable connector, whereby the second end of the at least one strut member may both rotate and pivot with respect to the harness assembly.

Another feature is that a strut member may be associated with each of the side walls and the back wall of the shell, with the first end of each strut member associated with the side walls being attached to each side wall at a location which substantially corresponds to an atlanto-occipital junction of a person wearing the protective helmet, and the first end of the strut member associated with the back wall of the shell may be attached intermediate the back wall at a location which substantially corresponds to the atlanto-occipital junction of the person wearing the protective helmet.

Another aspect of certain embodiments is a motion restrictor device adapted for use with a protective helmet having an upper wall, two side walls, and a back wall. The motion restrictor device may include: a force sensor adapted to be disposed adjacent the upper wall of the protective helmet; an acceleration sensor adapted to be disposed adjacent to one of the walls of the helmet or another aspect of the helmet that is connected to or moves with the shell of the helmet; at least one strut member having first and second ends, the first end of the least one strut member adapted to be associated with one of the walls of the protective helmet and the second end of the at least one strut member may be adapted to be associated with a harness assembly; the at least one strut member permits relative motion between the first and second ends of the at least one strut member; and a locking assembly associated with the at least one strut member, and the locking assembly, upon a predetermined force being sensed by the force sensor or a predetermined amount of acceleration or rate of acceleration being sensed by the acceleration sensor, having a first locked configuration stopping substantially all relative motion between the first and second ends of the at least one strut member. Another feature of this aspect of certain embodiments is that the locking assembly has a second, unlocked configuration that permits relative motion between the first and second ends of the at least one strut member, and this unlocked configuration occurs when the predetermined force, being sensed by the force sensor, is removed or the acceleration, sensed by the acceleration sensor, falls below the predetermined amount of or rate of acceleration. An additional feature is that the at least one strut member may comprise first and second tubular members, the first tubular member being telescopically received within the second tubular member for relative motion between the first and second tubular members. The locking assembly may be disposed within the at least one strut member and may include at least one wedge member that is engageable with an interior wall surface of one of the tubular members to substantially prevent relative motion between the first and second tubular members.

The locking assembly of certain embodiments may be associated with the first tubular member, and the second tubular member may have a plurality of grooves formed in the interior wall surface of the second tubular member, the at least one wedge member engageable with at least one of the plurality of grooves. An actuation system may be provided for the motion restrictor device, and it may be associated with the force sensor, and/or the acceleration sensor, and the locking assembly. The actuation system, upon a predetermined force being sensed by the force sensor or upon a predetermined amount of acceleration or rate of acceleration being sensed by the acceleration sensor, actuates the locking assembly to cause the at least one wedge member to engage the interior wall surface of one of the tubular members.

The present protective helmet when compared with previously proposed conventional helmets, is believed to have the advantages of: offering protection of the wearer of the helmet against injuries caused by impact forces exerted upon the top of the protective helmet, such as, for example, during the playing of the game of football or motorcycle sports; providing a motion restrictor device which is not bulky or unwieldy to wear or use, nor limits the movement of the helmet during normal activity except for limits, present at all times, that restrict head and neck flexion, extension, lateral flexion and rotational movement to normal, anatomic movement; and substantially locks the motion restrictor device to substantially prevent relative motion of the protective helmet with respect to the wearer of the protective helmet when a predetermined amount of force exerted on the helmet is exceeded, or a predetermined amount of acceleration or rate of acceleration in one or more planes of motion of the helmet is exceeded. The present protective helmet, when compared with previously proposed conventional helmets, is believed also to have the advantages of not requiring a full facial helmet as is required by some neck braces used in motorcycle sports that attempt to provide some cervical spine protection; and restricting the motion of the protective helmet by substantially locking the motion restrictor device with respect to the wearer of the protective helmet when a predetermined amount of force, or amount of acceleration or rate of acceleration in one or more planes of motion is exceeded.

Disclosed herein is a motion restrictor device adapted for use with a protective helmet, that includes an acceleration sensor adapted to be disposed in the protective helmet, a selectively reciprocating strut member connected on a first end to a protective helmet and connected to a harness assembly on a second end; and a locking assembly selectively operable in response to a threshold acceleration sensed by the acceleration sensor, having a first locked configuration stopping substantially all relative motion between the first and second ends of the at least one strut member. Optionally, upon the threshold acceleration being sensed by the acceleration sensor being reduced or removed, the locking assembly has a second, unlocked configuration permitting relative motion between the first and second ends of the at least one strut member.

The strut member may comprise first and second tubular members, the first tubular member being telescopically received within the second tubular member for relative motion between the first and second tubular members. The locking assembly may be disposed within the strut member. The locking assembly may include at least one wedge member engageable with a tubular member to substantially prevent relative motion between the first and second tubular members. The assembly may engage the tubular member on an interior wall surface.

The locking assembly is optionally associated with the first tubular member, and the second tubular member may include plurality of grooves formed in the interior wall surface of the second tubular member, the wedge member may be engageable with at least one of the plurality of grooves. Alternatively, an actuation system can be associated with the acceleration sensor and the locking assembly, the actuation system, upon a predetermined acceleration being sensed by the acceleration sensor, actuates the locking assembly to cause the at least one wedge member to engage the interior wall surface of one of the tubular members. Embodiment of the actuation system include, a hydraulic fluid passageway in fluid communication with the locking assembly and an electrical switch in electrical communication with the locking assembly.

The first end of the at least one strut member may include a connection assembly adapted to connect the first end of the at least one strut member to the protective helmet, the connection assembly including a rotatable and pivotable connector, whereby the first end of the at least one strut member may both rotate and pivot with respect to the wall of the protective helmet. The second end of the strut member can include a connection assembly adapted to connect the second end of the at least one strut member to the harness assembly, the connection assembly including a rotatable and pivotable connector, whereby the second end of the at least one strut member may both rotate and pivot with respect to the harness assembly.

Also optionally included is an abutment to limit the range of motion of the at least one strut member with respect to one of the walls of the protective helmet. The abutment may also limit the range of motion of the at least one strut member with respect to the harness assembly or can to limit the upward movement of the first end of the at least one strut member with respect to the second end of the at least one strut member, when the locking assembly is not in the first locked configuration.

Also disclosed herein is a protective helmet comprising a shell having an upper wall, two side walls, and a back wall; a acceleration sensor disposed adjacent the upper wall of the shell; at least one strut member having first and second ends, the first end of the at least one strut member is associated with one of the walls of the shell and the second end of the at least one strut member is associated with a harness assembly, the at least one strut member permitting relative motion between the first and second ends of the at least one strut member, and a locking assembly associated with the at least one strut member, the locking assembly, upon a predetermined acceleration being sensed by the acceleration sensor, having a first locked configuration stopping substantially all relative motion between the first and second ends of the at least one strut member, whereby the shell substantially does not move with respect to the at least one strut member and the predetermined acceleration is substantially transferred from the shell, through the at least one strut member, and to the harness assembly.

Optionally in this embodiment, the predetermined acceleration being sensed by the acceleration sensor being removed, the locking assembly has a second, unlocked configuration which permits relative motion between the first and second ends of the at least one strut member. The strut member may comprise first and second tubular members, the first tubular member being telescopically received within the second tubular member for relative motion between the first and second tubular members. The locking assembly is disposable within the at least one strut member, and includes at least one wedge member engageable with an interior wall surface of one of the tubular members to substantially prevent relative motion between the first and second tubular members. The locking assembly may be associated with the first tubular member, grooves may be formed in the interior wall surface of the second tubular member, the at least one wedge member engageable with a groove. An actuation system may be associated with the acceleration sensor and the locking assembly, the actuation system, upon a predetermined acceleration being sensed by the acceleration sensor, actuates the locking assembly to cause the at least one wedge member to engage the interior wall surface of one of the tubular members. The actuation system can include a hydraulic fluid passageway in fluid communication with the locking assembly and/or an electrical switch in electrical communication with the locking assembly.

The first end of the strut member can include a connection assembly connecting the first end of the at least one strut member to one of the walls of the protective helmet, the connection assembly including a rotatable and pivotable connector, whereby the first end of the at least one strut member may both rotate and pivot with respect to the wall of the protective helmet. The second end of the strut member may include a connection assembly connecting the second end of the at least one strut member to the harness assembly, the connection assembly including a rotatable and pivotable connector, whereby the second end of the at least one strut member may both rotate and pivot with respect to the harness assembly. A strut member may be associated with each of the side walls and the back wall of the shell, the first end of each strut member associated with the side walls being attached to each side wall at a location which substantially corresponds to an atlanto-occipital junction of a person wearing the protective helmet, and the first end of the strut member associated with the back wall of the shell being attached intermediate the back wall at a location which substantially corresponds to the atlanto-occipital junction of the person wearing the protective helmet. In an optional embodiment, three strut members are associated with the harness assembly, the harness assembly including three support portions, and two of the support portions are adapted to overlie a portion of a chest of a person wearing the protective helmet, and the third support portion is adapted to overlie a portion of a back of a person wearing the protective helmet, and the second ends of two of the strut members each being associated with one of the support portions overlying one of the portions of the chest, and the second end of the third strut member being associated with the third support portion.

An abutment can be included to limit the range of motion of the strut member with respect to one of the walls of the protective helmet, to limit the range of motion of the at least one strut member with respect to the harness assembly, and to limit the upward movement of the first end of the at least one strut member with respect to the second end of the at least one strut member, when the locking assembly is not in the first locked configuration.

BRIEF DESCRIPTION OF THE DRAWING

In the drawings:

FIG. 6 is an exploded view of a portion of the motion restrictor device attached to a portion of a side wall of the protective helmet and to a portion of the harness assembly of the present invention;

FIG. 11 is a partial cross-sectional view of another embodiment of a force sensor and actuation system, similar to that of FIG. 4, and taken along line 4-4 of FIG. 1;

While the invention will be described in connection with the preferred embodiments shown herein, it will be understood that it is not intended to limit the invention to those embodiments. On the contrary, it is intended to cover all alternatives, modification, and equivalents, as may be included within the spirit and scope of the invention as defined by the appended claims.

DETAILED DESCRIPTION OF THE INVENTION AND SPECIFIC EMBODIMENTS

Figure 2:
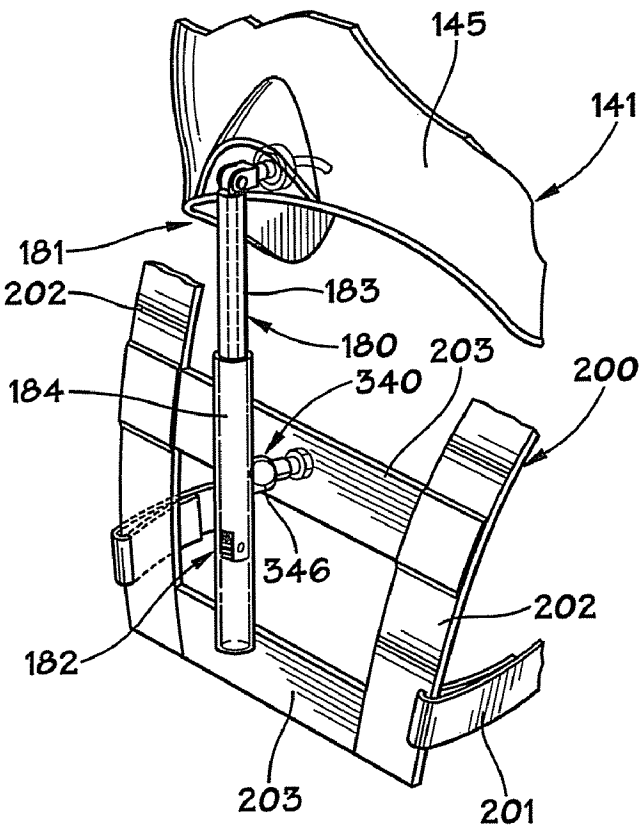
FIG. 2 is a partial, rear perspective view of a portion of the helmet of FIG. 1.
Figure 1:
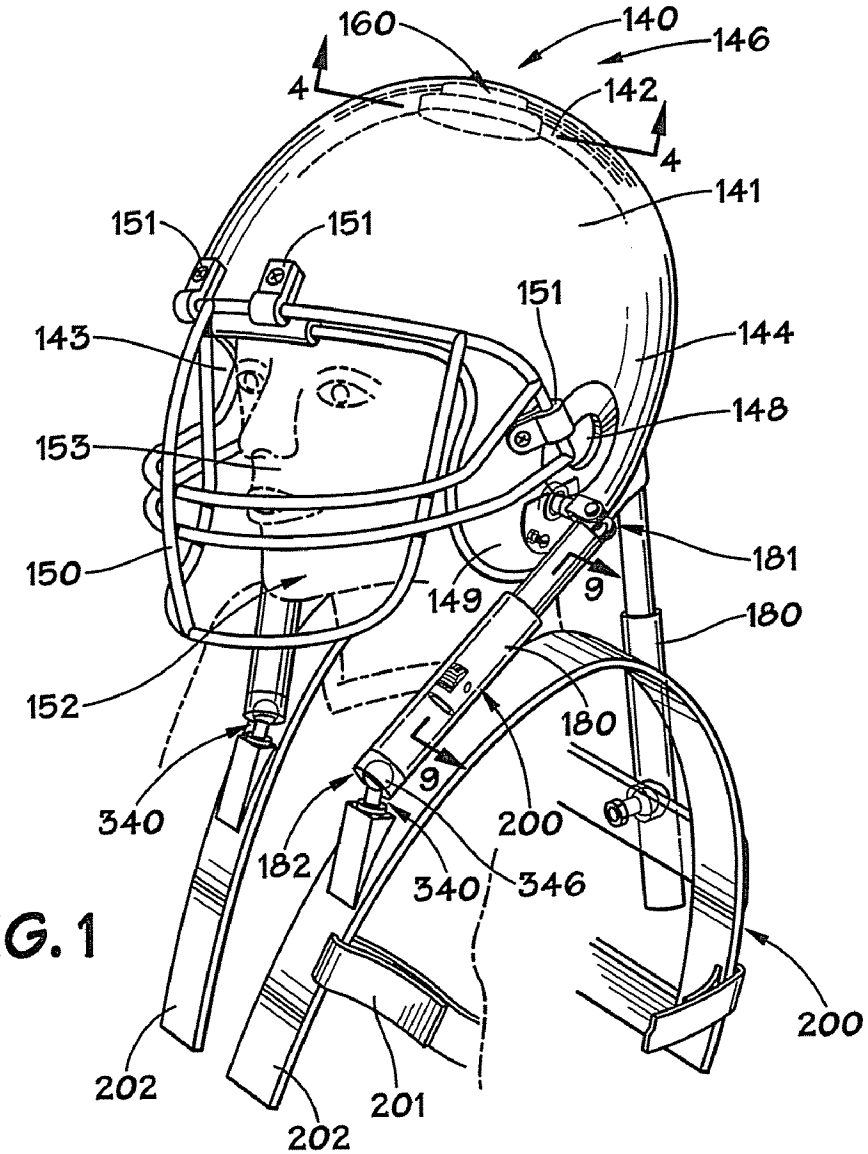
FIG. 1 is a perspective view of a protective helmet provided with a motion restrictor device.
Figure 3:
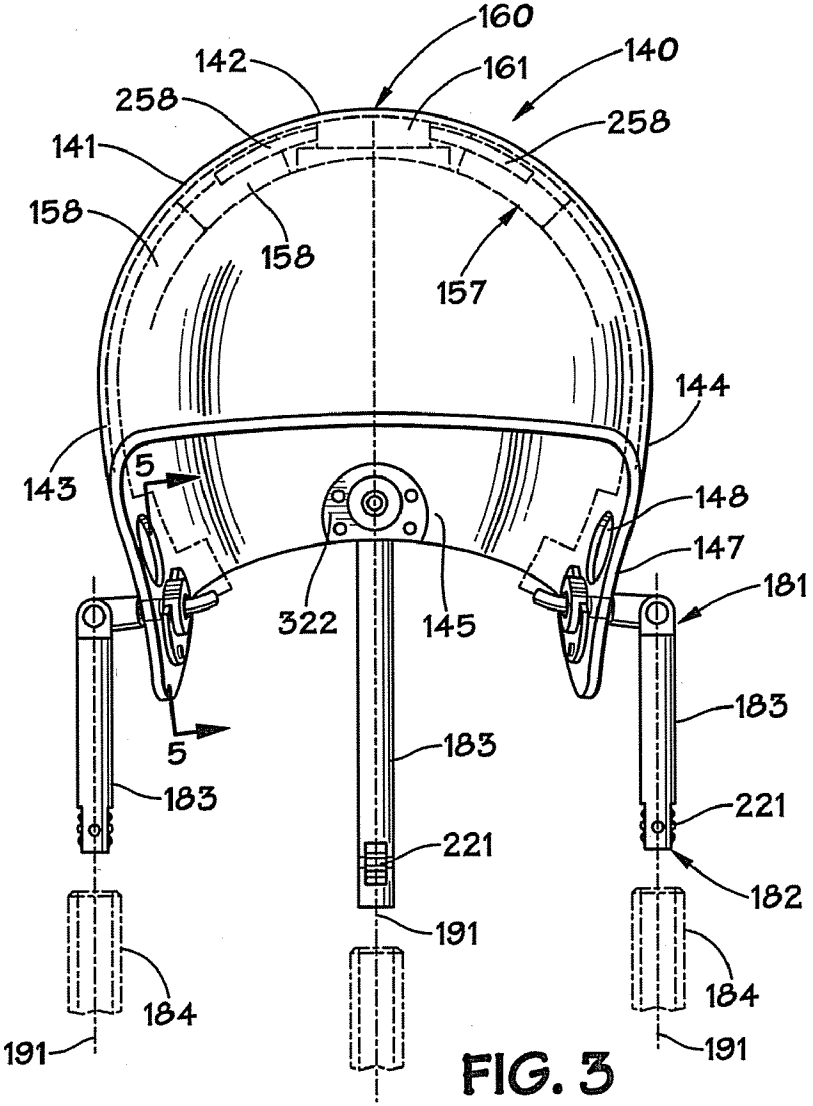
FIG. 3 is a partially exploded front view of the helmet of FIG. 1.

In FIGS. 1-3, a protective helmet 140 is shown to generally include: a shell 141 having an upper wall 142, two side walls 143, 144, and a back wall 145; a force sensor 160 disposed within the shell 141; at least one strut member 180 associated with one of the walls 143-145 of the shell 141; and a locking assembly 220 associated with the at least one strut member 180. Primed reference numerals will be used for components and structures similar in design and function to those denoted by unprimed reference numerals. As will be hereinafter described in greater detail, upon a predetermined force being sensed by the force sensor 160, or upon a predetermined amount of acceleration or rate of acceleration being sensed by the acceleration sensor (not pictured in attached drawings), the locking assembly 220 has a first locked configuration which stops substantially all relative motion between the ends of the at least one strut member 180, as well as substantially stops all relative motion between the protective helmet 140 and the at least one strut member 180. The at least one strut member 180 is associated with one of the walls 143-145 of the shell 141 and with a harness assembly 200.

With reference to FIGS. 1 and 2, protective helmet 140, which is illustrated in one embodiment as a conventional football helmet 146, includes conventional earflaps 147 (illustrated in FIG. 3) and ear openings 148, jaw flaps 149, a face guard 150, and face guard connectors 151. Shell 141 is preferably made of any suitable plastic material having the requisite strength and durability characteristics to function as a football helmet, or other type of protective helmet, such as polycarbonate plastic materials, one of which is known as LEXAN®, as is known in the art. Although a football helmet 146 is illustrated as a preferred embodiment of the protective helmet 140, it should be apparent to one of ordinary skill in the art, that protective helmet 140 of a similar or different shape could be of the type worn by motorcycle riders, motocross riders, mountain bike riders, bicycle riders, aircraft pilots, skiers, snowboard riders, ice hockey players, lacrosse players, pole-vaulters or players of other sports or activities in which protective helmets are worn, as well as protective helmets worn by industry workers, wherein the upper wall 142 of shell 141 may be struck by an impact force which could cause injury to the spine of the wearer 152 of the protective helmet 140.

As is known in the art, shell 141 is adapted to receive the head 153 of the person 152 wearing the protective helmet 140. The shell 141 also has an outer wall surface 155 and an inner wall surface 156 (FIGS. 3, 4, and 11) and a conventional shock absorbing liner 157 is associated with the inner wall surface 156 of shell 141 of protective helmet 140 as is known in the art. Shock absorbing liner 157 may include a plurality of resilient members 158 which are adapted to absorb forces exerted upon the shell 141, and the plurality of resilient members 158 are disposed along the inner wall surface 156 of shell 141, as is known in the art.

In a preferred embodiment of protective helmet 140, three strut members 180 are associated with shell 141 and harness assembly 200, as will be hereinafter described in greater detail. Preferably, the strut members 180 have identical or substantially similar construction and operation, thus one strut member 180 will therefore be described in detail. Optionally, a rear strut member may be longer than the side strut members. It should be understood by one of ordinary skill in the art that a greater or lesser number of strut members 180 may be utilized as desired dependent upon the purpose for which protective helmet 140 may be worn. With reference to FIGS. 1-3, each strut member 180 has first and second ends 181, 182, with the first end of each of the strut members 180 being associated with one of the walls 143-145 of the shell 141 and the second end 182 of each strut member 180 is associated with the harness assembly 200. As shown in FIGS. 1 and 3, a strut member 180 is associated with each of the side walls 143, 144 of shell 141 and a strut member 180 is associated with the back wall 145 of shell 141, as shown in FIG. 2.

As will be hereinafter described in greater detail, each strut member 180 permits relative motion between the first and second ends 181, 182 of the strut member 180. As will also be hereinafter described in greater detail, a locking assembly 220 is associated with each of the strut members 180, and the locking assembly 220, upon a predetermined force being sensed by the force sensor 160, or upon a predetermined acceleration being sensed by the acceleration sensor, will lock each strut member 180 into a first locked configuration which stops substantially all relative motion between the first and second ends 181, 182 of the at least one strut member 180. Preferably, the substantial stopping of all the relative motion between the first and second ends 181, 182 of all three strut members 180 occurs simultaneously. Additionally in the first locked configuration (FIG. 10), the helmet shell 141 substantially does not move with respect to each of the strut members 180 and the predetermined force that has been applied to the upper wall 142 of shell 141 is substantially transferred from the shell 141, through the strut members 180, and to the harness assembly 200. In this manner an impact force upon the upper wall 142 of protective helmet 140, which is capable of causing a cervical spinal injury to the wearer 152 if the force were directly transferred to the head 153 and spine of the person 152, is instead transferred from the top wall 142 of the protective helmet to the harness assembly 200, via the strut members 180.

As to the amount of the predetermined force which is sensed by the force sensor 160, or the amount of acceleration or rate of acceleration sensed by the acceleration sensor, which causes the actuation of locking assembly 220, the amount of that force or that acceleration may be determined by such factors as the age and weight of the person 152 wearing protective helmet 140 and the age and weight of other individuals which may cause an impact force to be received by the helmet 140. Additionally, it is believed that the age and weight of the wearer 152 of protective helmet 140 affect the threshold of force, or axial impact load, received by the top wall 142 of shell 141 and sensed by sensor 160, and also the threshold acceleration of the protective helmet sensed by the acceleration sensor, necessary to cause a serious injury to the spine and/or brain of the person 152 wearing the protective helmet 140. As will be hereinafter described in greater detail, the magnitude of the force which is sensed by force sensor 160 to cause actuation of the locking assembly 220 may be varied as desired. Use of the term "predetermined force" is meant a minimum impact force and an impact force in excess of the minimum impact force, which upon being sensed by the force sensor 160, leads to the actuation of the locking assembly 220 of each strut member 180. Use of the term "predetermined acceleration" is meant a minimum amount or rate of acceleration and acceleration in excess of the minimum amount or rate, which upon being sensed by the acceleration sensor, leads to the actuation of the locking assembly 220 of each strut member 180. Impact forces below the "predetermined force" and acceleration below the "predetermined acceleration" would not initiate the actuation of the locking assembly 220, whereby the person 152 wearing helmet 140 may normally move his head and neck and the movement thereof is not significantly limited. When protective helmet 140 is in the embodiment of a football helmet 146, the player's head 153 and neck movement is not significantly limited during normal play except for the limitation of head and neck rotation, lateral flexion, flexion, and extension to that of normal, anatomic movement. Use of the term "a threshold rate of movement" describes displacement, in any direction, between the helmet and harness described herein that when experienced by a wearer or user of the device and system described herein can cause injury to the wearer, such as a spinal injury. The "threshold rate of movement" can be precipitated by a force, velocity, or acceleration experienced by a wearer of the device herein described that can injure the wearer. Thus the threshold rate of movement can be the helmet velocity with respect to the harness as well as the rate of change of velocity, i.e. acceleration. The force experienced by the helmet can be directly measured, or estimated from a correlation of the helmet velocity and/or acceleration. The threshold rate of movement can thus include a force applied to or experienced by the helmet.

As shown in FIGS. 3 and 6, each strut member 180 may be comprised of first and second tubular members 183, 184, and the first tubular member 183 is telescopically received within the second tubular member 184, as by the first tubular member 183 having a smaller outer diameter than the inner diameter of the second tubular member 184. Thus, relative motion between the first and second ends 181, 182 of strut member 180 may occur, by the movement of first tubular member 183 with respect to second tubular member 184. First tubular member 183 has first and second ends 185, 186, and the second tubular member 184 has first and second ends 187, 188. The second end 186 of the first tubular member 183 contains two openings 351 (FIG. 7) equally spaced about the circumference that allow for the wedges 221 of the locking assembly 220 to protrude out of the first tubular member 183 when the locking mechanism is activated. Preferably the second end 186 of first tubular member 183 and the first end 187 of second tubular member 184 contain a stop mechanism to prevent disassembly of the first tubular member 183 and second tubular member 184 comprising strut 180. Preferably, strut members 180 are formed of a suitable rigid material, such as any suitable steel, aluminum, titanium, carbon fiber, or plastic material, capable of functioning in the manner described herein.

Preferably, each strut member 180 has a locking assembly 220 associated with each strut member 180, and the locking assembly 220 may preferably be disposed within the strut member 180. Locking assembly 220 preferably includes at least one wedge member 221 that is engageable with an interior wall surface of one of the tubular members 183, 184, to substantially prevent relative motion between the first and second tubular members 183, 184. Preferably, as shown in FIG. 6, the at least one wedge member 221 of locking assembly 220 is engageable with an interior wall surface 189 of the second tubular member 184. As will hereinafter be described in greater detail, each locking assembly 220 preferably includes at least two wedge members 221 substantially diametrically opposed from each other (FIGS. 3 and 8), and the interior wall surface 189 of the second tubular member 184 has a plurality of grooves formed in the interior wall surface 189. The wedge members 221 are engageable with at least one of the plurality of grooves 190. Preferably, as shown in FIG. 6, the plurality of grooves 190 are disposed substantially perpendicular to the longitudinal axis 191 of the strut members 180. If desired, a greater or lesser number of wedge members 221 could be utilized, although at least two are preferred. Preferably, the wedge members 221 are formed of a suitable material, such as a suitable steel, aluminum, titanium, carbon fiber, or rigid plastic material having the requisite strength characteristics to function in the manner described herein.

With reference to FIGS. 6 through 10, one embodiment of locking assembly 220 will be described in further detail. The two wedge members 221 are of substantially identical construction, and each includes a plurality of teeth-like members, or protrusions, 222 which upon outward movement engage with at least one of the grooves 190 formed in the interior wall surface 189 of tubular member 184 to lock first tubular member 183 with respect to the second tubular member 184, to prevent relative motion between the ends 181, 182 of the strut member 180. Each wedge member 221 preferably includes two spaced flanges 223 having an opening, or hole, 224 formed in each flange 223, and through which a pivot pin, or axle, 225 may pass. The two spaced flanges 223 on each wedge member 221 mate with the similarly spaced flanges 223 on the opposing wedge member 221. The pin 225 secures the wedge members 221 for pivotal movement about pin 225 at the lower end 186 of the first tubular member 183. Disposed within the first tubular member 183 of strut member 180 is a wedge member support assembly, or elevator, 226 that is telescopically received within the first tubular member 183. The support assembly 226 has an upper end 227 and a lower end 228 and the lower end 228 is provided with a pair of opposing, elongated slots 229, through which pivot pin 225 may pass through, as well as pass through openings 224 in wedge members 221. The lower end 228 of the support assembly, or elevator, 226 includes a pair of opposed openings 230 through which wedge members 221 may pass as they are pivoted outwardly toward the interior wall surface 189 of second tubular member 184. The upward and downward movement of elevator 226 within the first tubular member 183 is restricted by pin 225 engaging the upper or lower rounded ends 231, 232 of the pair of slots 229. Preferably, the wedge members 221 are equally spaced about the circumference of the support assembly, so that upon engagement of wedge members 221 with grooves 190, the application of force against the wall surface 189 of tubular member 184 will be substantially equal.

Still with reference to FIGS. 6-10, the upper end 227 of wedge member support assembly 226 includes two vertically extending legs 233, 234 and a horizontally extending crosspiece 235. Legs 233, 234 are spaced inwardly with respect to the circular base 236 of the lower end 228 of support assembly 226, whereby a compression spring 240 may be disposed between the legs 233, 234 and rest upon the circular base 236, as particularly shown in FIGS. 9 and 10. Legs 233, 234, and cross piece 235, along with circular base 236 of support assembly 226 define an opening, or housing, 237 which receives, or has disposed therein, a hydraulic cylinder and piston assembly 241, which includes a hydraulic cylinder 242 and a hydraulic piston 243.

Figure 7:
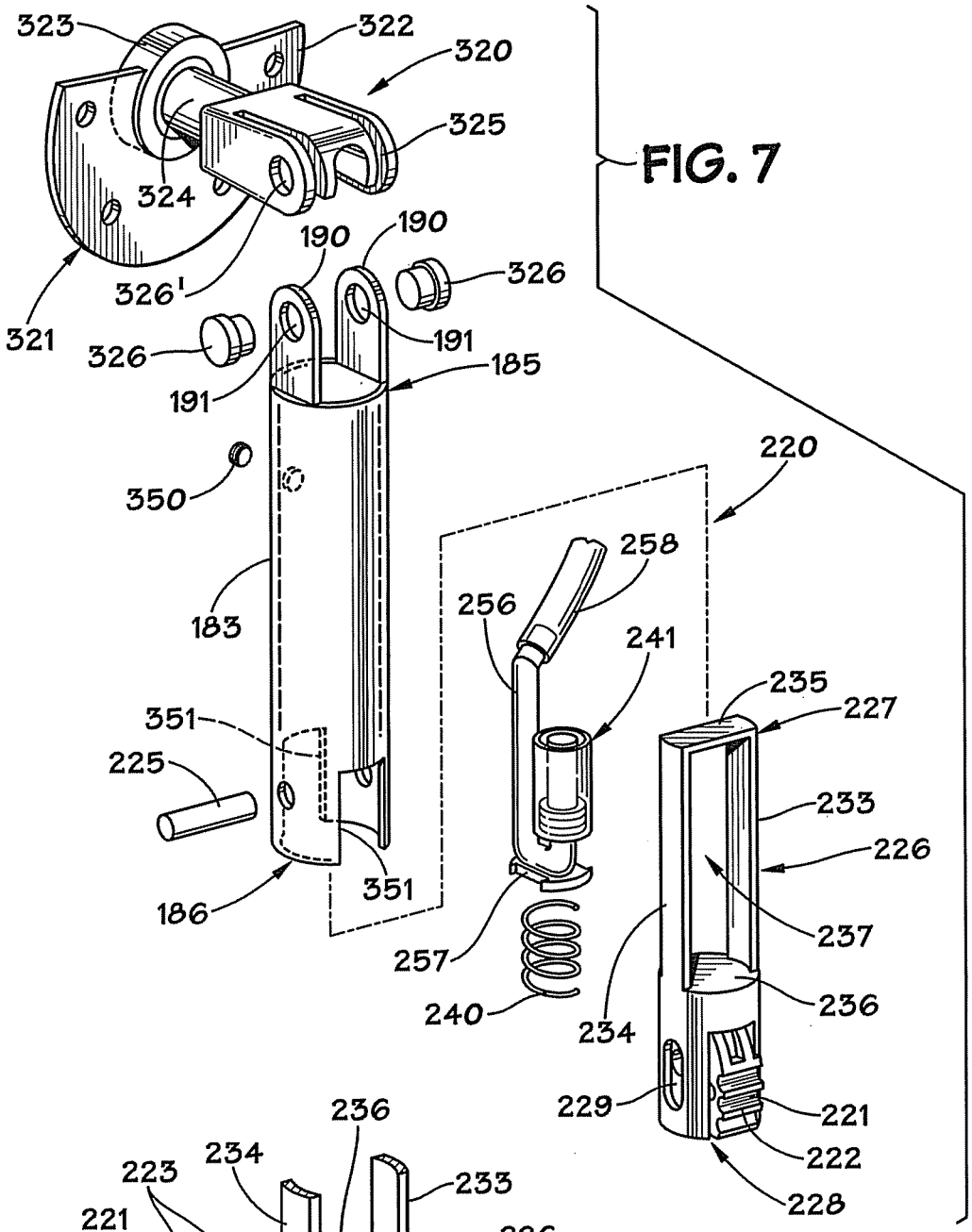
FIG. 7 is an exploded view, in greater detail, of a portion of the motion restrictor device shown in FIG. 6.
Figure 9:
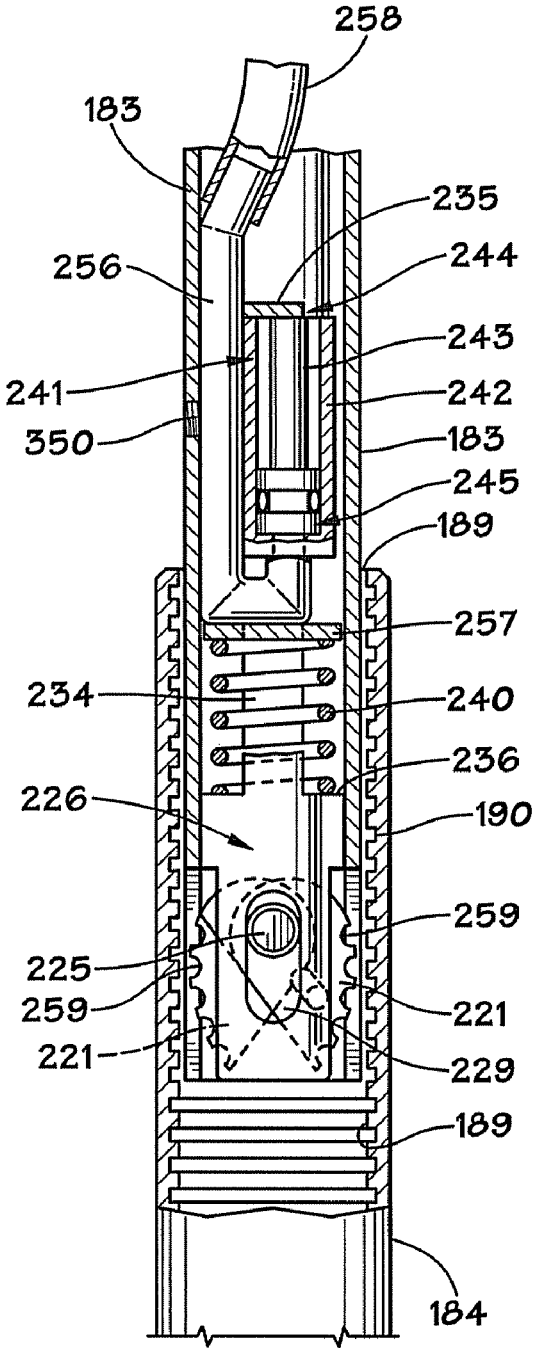
FIG. 9 is a partial cross-sectional view of a portion of the motion restrictor device taken along line 9-9 of FIG. 1, illustrating the locking assembly in its second, unlocked configuration.
Figure 10:
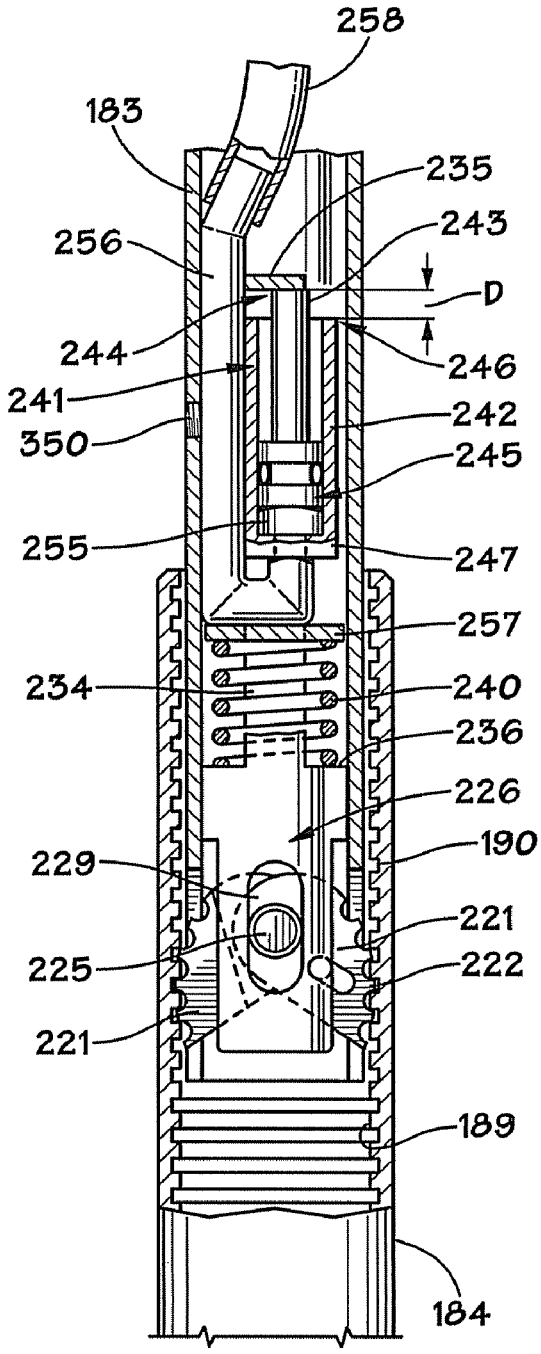
FIG. 10 is a partial cross-sectional view taken along line 9-9 of FIG. 1, illustrating the locking assembly in its first locked configuration.

As shown in FIGS. 9 and 10, the upper end 244 of piston 243 may be moved upwardly a distance D, as shown in FIG. 10, upon an application of a force by hydraulic fluid 255 upon the lower end 245 of piston 243. As seen in FIGS. 7, 9, and 10, the lower end 247 of hydraulic cylinder 242 has an opening formed therein and is in fluid communication with a hydraulic fluid passageway, or pipe, 256 which in turn is supported by, and preferably affixed to a circular disc member 257 which is secured by set screw 350 to the first tubular member 183. Preferably, the hydraulic fluid pipe, or passageway, 256 is made of a suitable non-expandable plastic or light metallic material, and preferably a rigid plastic or light metallic material. Preferably, the hydraulic pipe 256 is in fluid communication with a length of hydraulic fluid tubing 258 that is non-expandable, but is preferably made of a flexible plastic material. The hydraulic fluid tubing 258 substantially retains a constant internal diameter, regardless of the fluid pressure contained therein caused by the hydraulic fluid; however, the fluid tubing is flexible enough to bend and curve its way toward force sensor 160 as hereinafter described in further detail.

With reference to FIG. 9, locking assembly 220 is illustrated in its second unlocked configuration, wherein wedge members 221 have pivoted inwardly and are not in engagement with the interior wall surface 189 of second tubular member 184, or not engaged with at least one groove 190 formed within interior wall surface 189. Compression spring 240 pushes against disc member 257, which is secured to the inner wall of the first tubular member 183, and spring 240 in turn exerts a downward force on circular base 236, which is connected to legs 233 and 234 of wedge member support assembly 226. The lower end 228 of support assembly 226 extends beyond disc member 236 and has opposed openings equally spaced around the circumference through which wedge members 221 may pass. Each of the two aspects of the support assembly 226 that are adjacent to the wedge members 221 have a small stud that protrudes into a groove within the side of each wedge member 221. Each protruding stud articulates with one of the wedge members 221. When the locking mechanism 220 is in the second, unlocked configuration, the downward force exerted by spring 240 on disc member 236, and in turn on the entire support assembly 226, is transmitted to the wedge members 221 through the articulation of the studs protruding from the support assembly 226 with the grooves on the side of each wedge member 221. This forces the wedge members 221 to be pivoted inwardly and therefore not in engagement with the interior wall surface 189 of second tubular member 184, or not engaged with at least one groove 190 formed within interior wall surface 189. In the second, unlocked configuration of FIG. 9 the piston 243 does not extend outwardly beyond the upper end 246 of cylinder 242, but rather both the upper end 244 of piston 243 and the upper end 246 of cylinder 242 are in an abutting relationship with the underside of cross member 235. The second, unlocked configuration, corresponds to the situation when the force resulting from the pressure of the hydraulic fluid 255, present in hydraulic cylinder 242 is not sufficient to overcome the spring biasing force of spring 240 to move piston 243 upward.

Figure 8:
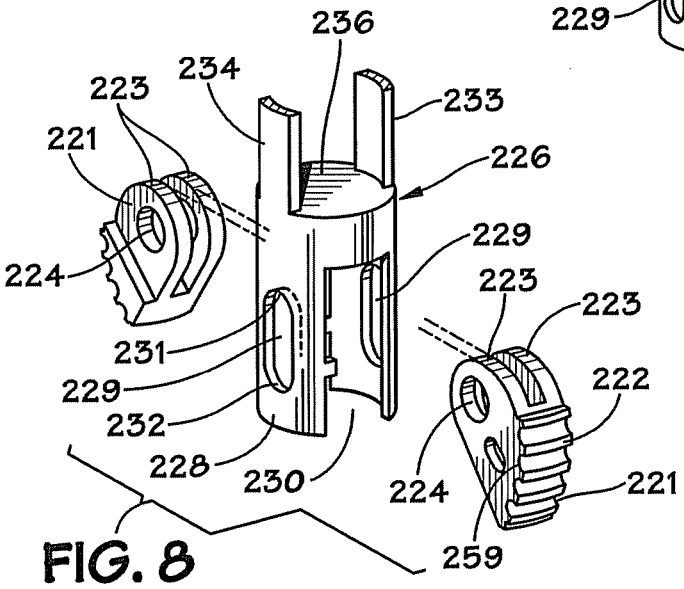
FIG. 8 is an exploded view of a portion of the motion restrictor device shown in FIG. 7.

FIG. 10 depicts locking assembly 220 in its first locked configuration wherein wedge members 221 are engaged with the interior wall surface 189 of the second tubular member 184 of strut member 180, and in particular, the teeth 222 of wedge members 221 are in engagement with at least one, and preferably a plurality, of grooves 190 formed within the interior wall surface 189 of second tubular member 184. This engagement of wedge members 221 is caused by a sufficient force being exerted upon piston 243 by hydraulic fluid 255, which force is greater than the biasing force exerted by compression spring 240 against disc member 257 and against circular base 236. As wedge member support assembly 226 moves upward and pivot pin 225, which is secured to inner tube member 183, moves within slots 229 in the lower end 228 of support assembly 226, and such movement causes wedge members 221 to each pivot outwardly into engagement with the grooves 190 as shown in FIG. 10. As greater hydraulic fluid pressure acts against the bottom of piston 243 in cylinder 242, the piston 243, which is in contact with the cross piece 235 of support assembly 226, causes the wedge support assembly 226 to move upward from the configuration shown in FIG. 9 to the configuration shown in FIG. 10, wherein a plurality of teeth 222 of wedge members 221 are fully engaged with grooves 190. With the teeth 222 of wedge members 221 engaged with grooves 190 of outer tube member 184, the greater the axial force applied to the upper wall 142, or crown, of protective helmet 140 the greater the downward force on inner tube member 183, and in turn on axis pin 225 which is secured to inner tube member 183. This causes proportionally greater rotational forces of the wedge members 221 about the axis pin 225. Due to the shape of wedge members 221, as seen in FIG. 8, the more the wedge members 221 are rotated outward about their rotational axis, pin 225, the greater the distance between the lateral aspect of the two wedges 221, and thus the greater the outward force exerted on the inner wall 189 of outer tube member 184. The outer tube member 184 is constructed to withstand this outward force and the effect is that inner tube member 183 and outer tube member 184 are immediately locked and remain locked until the axial force on the upper wall 142, or crown, of the helmet 140 is removed. With inner tube member 183 and outer tube member 184 locked, the axial force applied to the upper wall 142, or crown, of protective helmet 140 is transmitted through the shell 141 of the protective helmet 140, through the at least one strut member 180 to the harness assembly 200, thus the cervical spine of wearer 152 of protective helmet 140 is spared from further axial compression forces. The grooves 190 matingly receive the complementary shaped teeth 222 of the wedge members 221 to prevent any slipping of the wedge members with respect to interior wall surface 189 of tubular member 184. As seen in FIGS. 8-10, the teeth 222 are disposed upon wedge members 221 upon an outer curved wall surface 259 that has a varying radius with respect to openings 224.

When the hydraulic fluid pressure from hydraulic fluid 255, and therefore the force bearing against the lower end 245 of piston 243, is reduced below the magnitude of the biasing force of spring 240, the elevator 226 descends until it is in the configuration shown in FIG. 9. As elevator 226 descends, the wedge members 221 pivot out of engagement with the grooves 190, whereby unhindered relative motion between the first and second ends 181, 182 of strut members 180, or between the tubular members 183, 184 may again occur.

Figure 4:
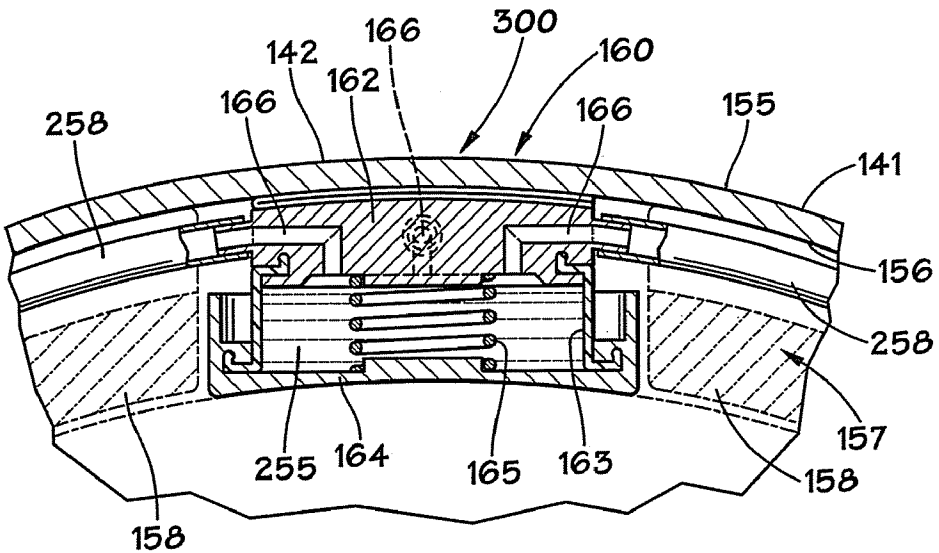
FIG. 4 is partial cross-sectional view of the helmet of FIG. 1 and a portion of one type of force sensor as part of the motion restrictor device taken along line 4-4 of FIG. 1.
Figure 5:
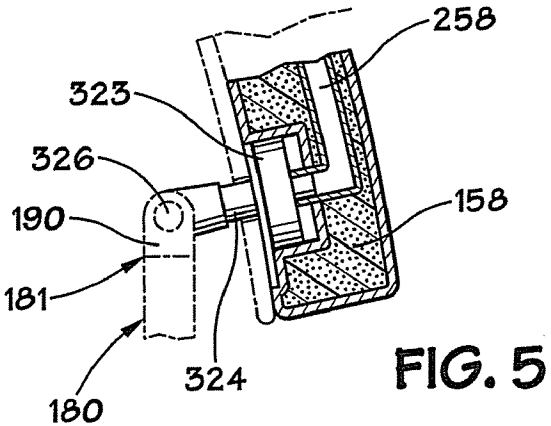
FIG. 5 is a partial cross-sectional view of a portion of the helmet of FIG. 3 taken along line 5-5 of FIG. 3.

The actuation of locking assembly 220 is caused by an actuation system 300 associated with the force sensor 160, as will be described in connection with FIGS. 3-5. As previously discussed, force sensor 160 is disposed with the shell 141, in one embodiment the force sensor 160 is disposed beneath upper wall 142 adjacent the interior wall surface 156 of shell 141 as shown in FIGS. 3 and 4. Force sensor 160 may be disposed adjacent the upper wall 142 at a location which corresponds to the crown, or uppermost portion, of shell 141 above the uppermost portion, or crown, of the head 153 of the wearer 152 of helmet 140. This location generally corresponds to a location that substantially intersects the longitudinal axis of the cervical spine of wearer 152. Force sensor 160 includes a fluid-filled reservoir, or hydraulic fluid reservoir, 161 containing hydraulic fluid 255. Hydraulic fluid 255 may be any suitable fluid that is substantially incompressible, and is compatible with the materials used for force sensor 160 and actuation system 300. Fluid reservoir 161 is defined by a rigid top member 162, a flexible, circular, cross-sectional shaped wall member 163 and a circular shaped base member 164 which sealingly engages with flexible wall member 163. The upper end of flexible wall member 163 is sealingly engaged with the upper top member 162. Disposed within reservoir 161 is a compression spring 165. Equal sized fluid passageways 166 are formed in the top member 162 in a fluid transmitting relationship with the hydraulic fluid 255 disposed within the sealed fluid reservoir 161. Because of the flexible, but non-expandable nature of the outer circular wall member 163, relative motion between the top member 162 and the bottom member 164 is possible, and such motion will cause the expelling of hydraulic fluid from reservoir 161 into the three passageways 166 in substantially equal amounts and under substantially equal force.

Each fluid passageway 166 is in fluid communication with a length of flexible, but non-expandable, tubing 258, as previously described in connection with FIGS. 7, 9, and 10. The flexible tubing 258 may extend from fluid reservoir 161 along the inner wall surface 156 of shell 141 until its lower end is secured to a hydraulic fluid pipe 256 associated with each locking assembly 220 in the following manner. For strut members 180 associated with the sidewalls of 143, 144, of shell 141, the lengths of flexible tubing 258 pass downwardly toward the desired location where the upper ends 181 of strut members 180 are associated with sidewalls 143, 144, as shown in FIG. 3. Flexible tubing 158 is passed downwardly, as will hereinafter be described in greater detail, into each strut member 180 and is then passed downwardly until it is secured to pipes 256 in each strut member 180. As seen in FIG. 4, the padding members 158 of liner 157 may be provided with several passageways through which flexible tubing 258 may pass. In a similar manner, a length of flexible tubing 258 to be associated with the strut member 180 associated with the back wall 145 of shell 141 is similarly passed through, or within liner 157, or is disposed between separate padding members 158, and then to the desired location at which the strut member 180 is attached to the back wall 145 of shell 141. An alternative arrangement may involve rigid tubes molded along or within the inner wall surface 156 of shell 141 extending from fluid reservoir 161 to the site where the upper ends 181 of strut members 180 are associated with side walls 143 and 144 and/or back wall 145. At this site, flexible tubing sealingly is attached to the rigid tubes and extends into strut member 180 as described.

With reference to FIG. 4, it should be noted that compression spring 165 serves to bias the top and bottoms members 162, 164 of reservoir 161 into the configuration illustrated in FIG. 4. In the configuration of FIG. 4 an insufficient amount of force is exerted upon compression spring 165, and thus an insufficient force is exerted by hydraulic fluid 255 against piston 242, as previously described in connection with FIG. 9. In FIG. 9, locking assembly 220 is in its second, unlocked configuration. Upon a sufficient predetermined axial load, or impact force, being exerted, or being impacted, upon the upper wall or crown of shell 141 and being sensed by sensor 160, hydraulic fluid 255 is forced outwardly from reservoir 161 into fluid passageways 166 and into flexible tubing 258 to thus cause the movement of wedge member support assembly 226 in the manner previously described in connection with FIG. 10. The amount of force which actuates the locking assembly 220 in the embodiment illustrated in FIG. 4 is a function of the spring constant of the compression spring 165 and 240. In other words, the stiffer compression spring 165 is, the greater the force which must be exerted against it in order to expel hydraulic fluid 255 from fluid reservoir 161. Thus, by selection of the compression spring 165 and compression spring 240, which is located in each locking assembly 220 in each strut 180, and their spring constants, the desired minimum amount of force that must be exerted upon force sensor 160 can be determined and selected. It should be noted that the lower member 164 of fluid reservoir 161 would be associated, or in contact, with the top of the head 153 of wearer 152, so that as shell 141 moves downwardly, as a result of a force being applied to the upper wall surface 155 of shell 141, compression spring 165 is compressed between that force, and the upwardly exerted force of the wearer's head 153 against the bottom member 164 of fluid reservoir 161. Thus, upon the predetermined force being sensed by force sensor 160, the actuation system 300, which includes the hydraulic fluid 255 and its associated tubing 258, causes locking assembly 220 to be actuated. Strut members 180 are simultaneously actuated, whereby the force exerted upon shell 141 is transferred via strut numbers 180 to harness assembly 200.

The reservoir 161, tubing 258, passageways 166, and pipe 256 are all initially filled with hydraulic fluid 255, preferably without any air being present therein, until locking assembly has the configuration illustrated in FIG. 9, and reservoir 161 is in the fully expanded configuration illustrated in FIG. 4. Thus, a sealed hydraulic system is provided, and will be operable regardless of the orientation of helmet 140, including helmet 140 being upside down. If the wearer of helmet 140 should be thrown into the air and is falling downwardly to the ground to land with the top of helmet 140 striking the ground, the force of that impact would cause actuation of locking assemblies 220, to attempt to afford protection against a cervical spine injury cause by such impact.

With reference to FIGS. 1, 3, 5, and 6, the association of the upper ends 181 of each strut member 180 to a wall 143-145 of shell 141 will be described. The upper end 181 of each strut member 180 preferably includes a connection assembly 320, which includes a rotatable and pivotable connector 321. As seen in FIG. 7, the upper end 185 of first tubular member 183 may be provided with two opposed flange members 190 having openings 191 formed therein. A connector mounting plate 322 may be secured as by with rivets, bolts or screws 323 (FIG. 6) to a wall 143-145 of shell 141. Disposed within mounting plate 322 is a rotational mounting device, such as a ball bearing 323, which is secured to a hollow rotatable shaft 324, through which tubing 258 may pass. The other end of rotatable shaft 324 is secured to a female flange connector 325 having openings 326 formed therein, and the flanges 190 associated with the upper end 185 of the first tubular member 183 as matingly received within female flange connector 325 and are pivotally secured thereto as by pivot pins 326. Thus, the first end 181 of the strut member 180, or the upper end 185 of the first tubular member 183, may both rotate and pivot outwardly and inwardly with respect to a wall 143-145 of shell 141. Connection assembly 320 thus permits relatively unrestrained movement of helmet 140 with respect to the strut members 180 when locking assemblies 220 are not engaged. Alternatively, other types of rotatable and pivotal connectors may be utilized such as a ball and socket hinge or any type of connector which permits tubing 258 to be associated therewith and which also permits strut member 180 to rotate and pivot with respect to the wall of shell 141 to which it is attached. If desired, suitable stops or abutments, some of which will be hereinafter described, may be provided to somewhat limit the range of motion of the strut members 180 even when the locking assemblies 220 are not engaged, to limit the struts' range of motion to that of normal, anatomical head and neck movement. The risk of injury by a torsional force upon the helmet 141, which is typically caused by a facemask violation in the sport of football, and the risk of hyper-flexion, hyper-extension, and hyper-lateral flexion related injuries may thus also be diminished. In this regard, it should be noted that only the application of an axial blow or force upon the crown or upper wall 142 of the helmet 140, and sensed by force sensor 160 to be the same as, or in excess of the pre-determined force, or the amount of acceleration or rate of acceleration, being sensed by the acceleration sensor, to be the same as or in excess of the predetermined amount of or rate of acceleration, can actuate the locking assemblies 220.

Similarly, with reference to FIGS. 1, 2 and 6, the second ends 182 of each strut member 180 may include a connection assembly 340 which connect the second ends 182 of each strut member 180 to harness assembly 200. Harness assembly 200 preferably snuggly fits against the player's shoulders, chest, and upper back, as by overlying: the player's shoulders; a portion of the player's chest; and a portion of the player's upper back. Harness assembly 200 is relatively rigid, so as to be capable of absorbing and transferring the force exerted upon strut members 180 to the player's chest, shoulders and back portions. Harness assembly 200 may be strapped under the player's arms to secure to the player's body, as by straps 201. Harness assembly 200 may be of any suitable design or construction; however, preferably, it includes two shoulder arch members 202 formed of a rigid metal or plastic material and arch members 202 may be connected by a plurality of rigid connector members 203 disposed adjacent to the back of the person wearing the helmet 140. Conventional shoulder pads (not shown) may be connected to, or simply worn over, harness assembly 200, or alternatively, harness assembly 200 may be incorporated into a set of football shoulder pads. The connection assemblies 340, for the lower ends 182 of the strut members 180 associated with the side walls 143, 144 of shell 141 may include a rotatable and pivotable connector 345, whereby the second ends 182 of the strut numbers 180 may both rotate and pivot with respect to harness assembly 200. Preferably, as shown in FIGS. 1 and 6, the rotatable and pivotable connector 345 may be a ball and socket connector 346 that permits the desired rotation and pivoting of the second end 182 of strut member 180 with respect to harness assembly 200. With reference to FIG. 2, the connection assembly 340 for the lower end of strut member 180 associated with the back wall 145 of shell 141 may also be comprised of a ball and socket connector 346.

Preferably, the upper ends 181 of strut members 180 associated with each of the side walls 143, 144 of shell 141 are attached to each side wall 143, 144 at a location which substantially corresponds to the atlanto-occipital junction of the person 152 wearing helmet 140. In general, as seen in FIGS. 1 and 6, this location generally corresponds to mounting plate 322 being disposed on the side wall 143, 144 slightly below and forward of the ear opening 148 of ear flap 147. The first end 181 of the strut member 180 associated with the back wall 145 of shell 141 of helmet 140 is preferably attached intermediate, or in the middle of, the back wall 145 at a location which substantially corresponds to the atlanto-occipital junction of the person wearing the protective helmet 140, as shown in FIGS. 2 and 3.

Preferably, the outer surfaces of the connection assemblies 320, 340, and strut members 180 are substantially smooth and rounded, without any sharp edges, whereby a person contacting the connection assemblies or strut members will not be injured, as by cutting their hand, for example. There also may be any suitable design of padding and/or material covering and extending between struts 180 to aid in protecting against injury of other players. The connection assembles 320, 340 may also be formed of any suitable material which permits them to function in the manner herein described, such as any suitable steel or metallic material, aluminum, titanium, carbon fiber or any suitable rigid plastic material.

Figure 13:
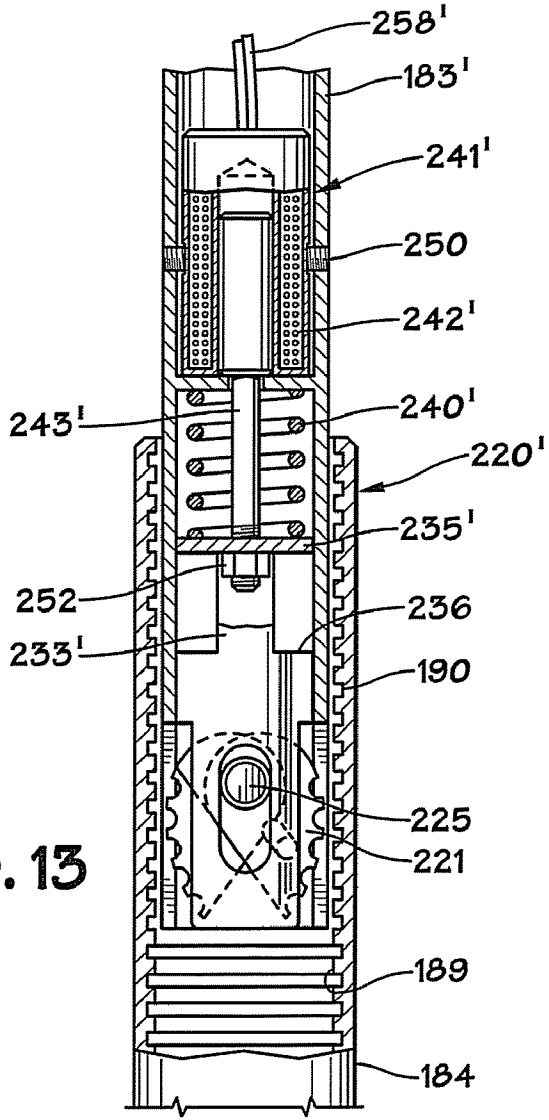
FIG. 13 is a partial cross-sectional view of the embodiment of the locking assembly of FIG. 12, the view being similar to FIGS. 9 and 10, and taken along line 9-9 of FIG. 1.
Figure 12:
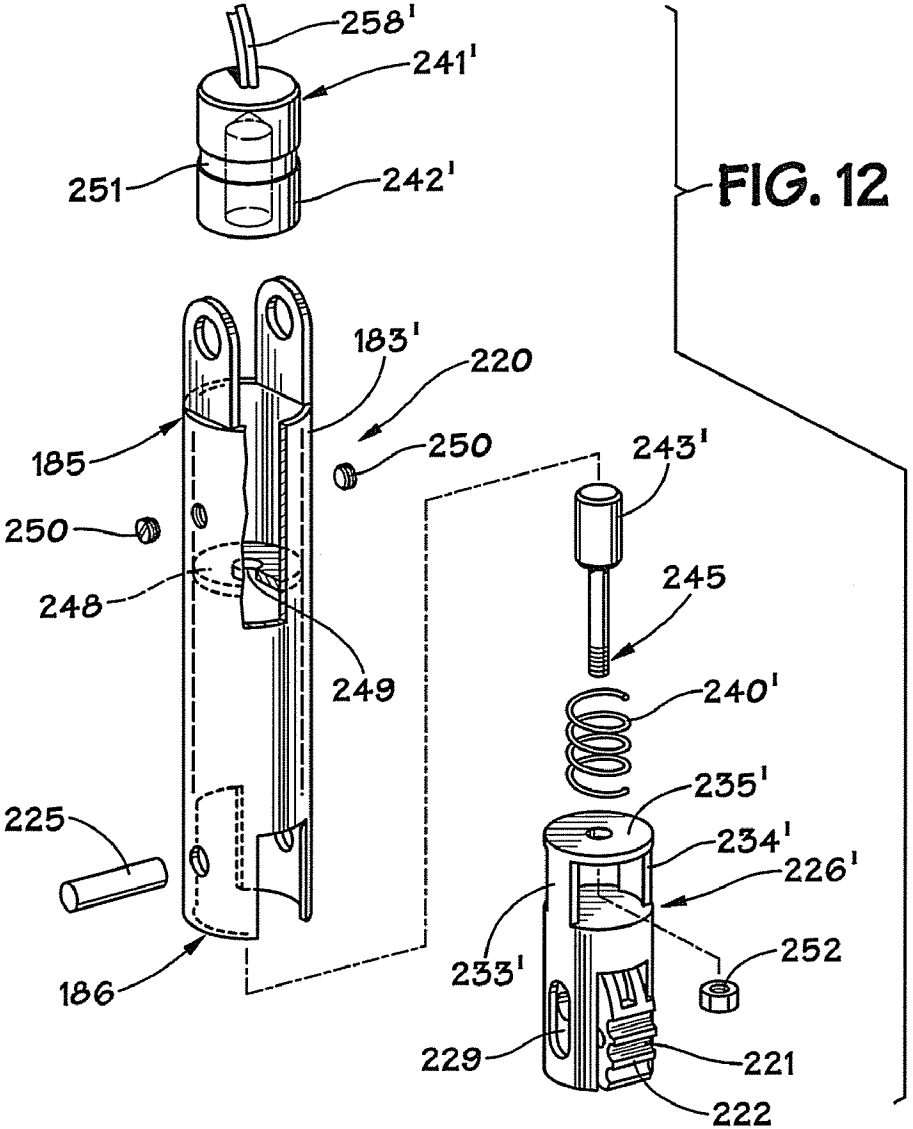
FIG. 12 is an exploded view of another locking assembly, adapted for use with the actuation system and force sensor of FIG. 11.

With reference to FIGS. 11-13, another embodiment of a force sensor 160', actuation system 300', and locking assembly 220' will be described. The same reference numerals will be used for identical components previously described, and primed reference numerals will be used for components having similar functions and/or structures to those previously described. Force sensor 160' is also disposed adjacent the upper wall 142 of shell 141, and is preferably disposed beneath upper wall 142 adjacent the interior wall surface 156 of shell 141 as shown in FIG. 11. The acceleration sensor preferably is also be disposed adjacent the upper wall 142 of shell 141 but can be disposed at other locations adjacent to some aspect of the protective helmet that moves with or is connected to the shell 141. Force sensor 160' is preferably disposed adjacent the upper wall 142 at a location which corresponds to the crown, or upper-most portion, of shell 141 above the upper-most portion, or crown, of the head 153 of the wearer 152 of helmet 140'. This location also generally corresponds to a location that substantially intersects the longitudinal axis of the cervical spine of wearer 152. Force, or pressure, sensor 160' may have a spring-loaded switch 171 of activation system 300' disposed within a housing 172, switch 171 being in an electrically transmitting relationship with a battery 173, or other source of electricity. Upon sensor 160' sensing an axial force equal to, or in excess of, the predetermined force previously described, or upon the acceleration sensor sensing an amount of acceleration or rate of acceleration equal to, or in excess of, the predetermined amount of or rate of acceleration, switch 171 closes and permits transmission of an electric current through wiring 258'. Housing 172 is preferably disposed adjacent the interior wall surface 156 of shell 141 at its upper end, and is adapted to be disposed adjacent the head 153 of the wearer 152 of helmet 140', at its lower end. Electrical wiring 258' serves a similar function as hydraulic tubing 258 of actuation system 300 previously described, in that, as seen in FIG. 12, electrical wiring 258' is in an electrical transmitting relationship between switch 171 and locking assembly 220'. Preferably, electrical wiring 258' is connected to a solenoid switch 241', which includes a coil 242' and a piston 243' or other linear actuator, for example an electro-active polymer actuator. Intermediate the upper and lower ends 185, 186 of tubular member 183' is disposed a solenoid support flange 248 having an opening 249 disposed therein. Solenoid 241' is received within tubular member 183' and rests upon support flange 248, and is secured thereto, as by a pair of set-screws 250 which engage solenoid 241', or other linear actuator, in an annular groove 251 formed in the body of solenoid 241', or other linear actuator. The lower end 245 of piston 243' passes through the opening 249, and extends downwardly toward wedge member support assembly 226'. The lower end 245 of piston 243' is threaded for receipt of a nut 252.

With reference to FIGS. 12 and 13, wedge member support assembly 226' is received within the lower end 186 of tubular member 183', and has mounted therein wedge members 221, as previously described. Wedge member support assembly 226' has a generally cylindrical shape, and a substantially circular cross-sectional configuration. In this regard, it should be noted that although strut members 180, and tubular members 183, 184, and 183' have been illustrated to have a generally circular cross-sectional configuration, as well as a generally cylindrical shape, it should be understood by one of ordinary skill in the art that the cross-sectional configurations of these components could have other shapes, such as square, hexagonal, etc., although a circular cross-sectional configuration is preferred. Wedge member support assembly 226' includes circular base 236 and two upwardly extending legs 233', 234' joined by a generally horizontally disposed cross piece 235' having an opening formed therein through which the lower end 245 of piston 243' may pass. Nut 252 is disposed in threaded engagement with the lower end 245 of piston 243', and abuts the underside of crosspiece 235'. Alternatively the nut 252 may be attached to the underside of crosspiece 235'. Disposed between support flange 248 and cross piece 235', and disposed about the lower end of piston 243' is a compression spring 240'. Compression spring 240' biases wedge member support assembly 226' downwardly into the second unlocked configuration as shown in FIG. 13, which is similar to that of FIG. 9, wherein wedge members 221 are not engaged with the plurality of grooves 190 formed in the interior surface 189 of tubular member 184. Upon solenoid 142', or other linear actuator, being actuated by receiving an electric current via wiring 258', piston 243' is raised, whereby wedge member support assembly 226' moves upwardly to the first locked configuration similar to that previously described in connection with FIG. 10, whereby wedge members 221 pivot outwardly into engagement with the grooves 190 in the manner illustrated in connection with FIG. 10. Upon removal of the electrical current from actuation system 300', compression spring 240' biases and pushes wedge member support assembly 226' downwardly into the configuration shown in FIG. 13.

Figure 14:
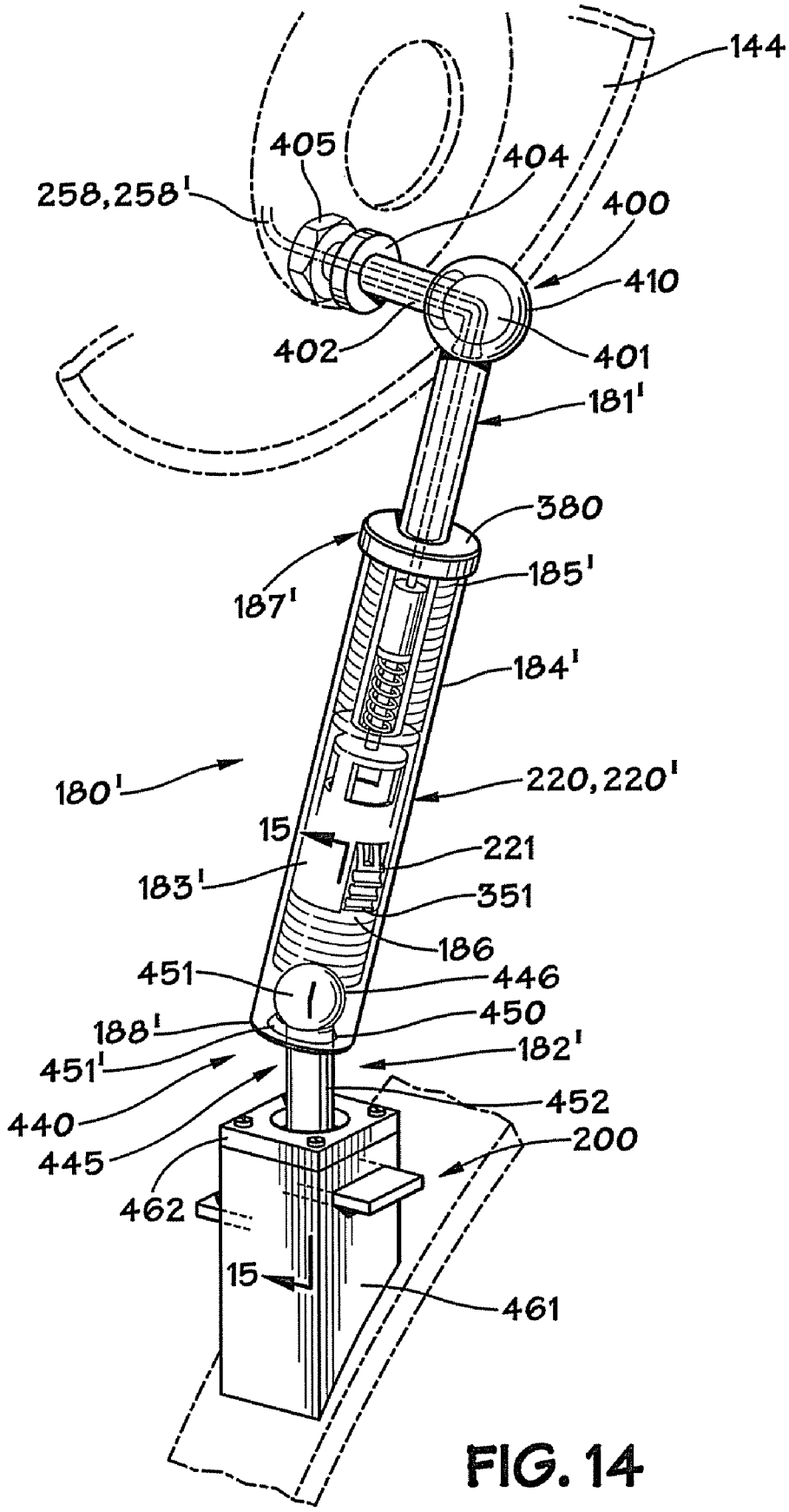
FIG. 14 is a partial cross-sectional view of another embodiment of a portion of a motion restrictor device.
Figure 15:
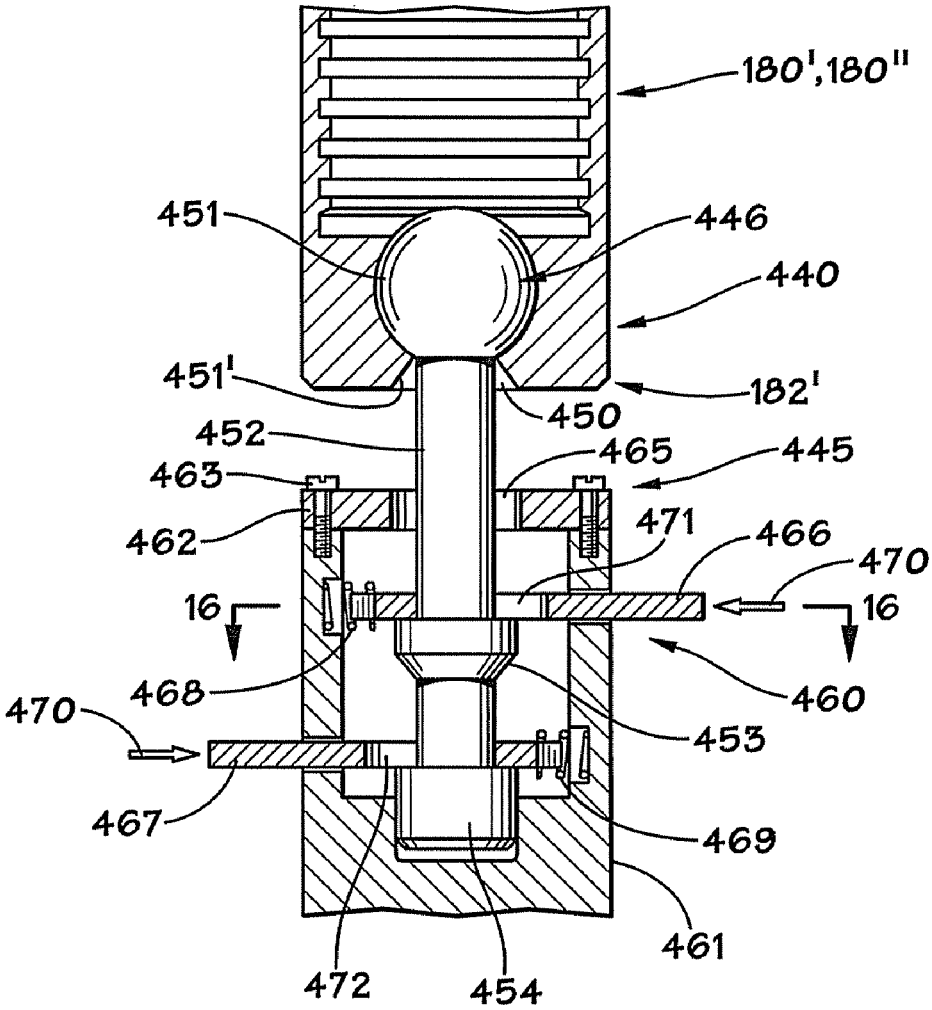
FIG. 15 is a partial cross-sectional view of a portion of a motion restrictor device generally corresponding to one taken along line 15-15 in FIG. 14.

As shown in FIGS. 14 and 15, another embodiment of strut member 180' may be comprised of first and second members 183', 184', and the first member 183' is telescopically received within the second, or second tubular, member 184'; as by the first member 183' having a smaller outer diameter than the inner diameter of the second tubular member 184'. Thus, relative motion between the first and second ends 181', 182' of strut member 180' may occur, by the movement of first tubular member 183' with respect to second tubular member 184'. First tubular member 183' has first and second ends 185', 186', and the second tubular member 184' has first and second ends 187', 188'. The second end 186' of the first tubular member 183' contains two openings 351 equally spaced about the circumference that allow for the wedges 221 of the locking assembly 220, to protrude out of the first tubular member 183' when the locking mechanism is activated. Preferably the outer surface of the first end 187' of second tubular member 184' is threaded to threadedly receive a cap member 380 to permit assembly of the first tubular member 183' and second tubular member 184' comprising strut 180', as well as prevent disassembly thereof. Preferably, strut members 180' are formed of a suitable rigid material, such as any suitable steel, aluminum, titanium, carbon fiber, or plastic material, capable of functioning in the manner described herein. Preferably, each strut member 180' has a locking assembly 220 associated with each strut member 180', and the locking assembly 220 may be the same as locking assemblies 220 and 220' previously described, including wedge members 221.

Still with reference to FIGS. 14 and 17, the association of the upper ends 181' of each strut member 180', 180" to a wall 143-145 of shell 141 will be described. The upper end 181' of each strut member 180', 180" preferably includes a connection assembly 400. Connection assembly 400 may include a ball member 401 disposed at the end of a tubular shaft 402 having a threaded end 403 and a flange 404, whereby upon a nut 405 being threaded upon the threaded end 403 of shaft 402, the ball member 401 and shaft 402 are secured to wall 144 of shell 141 (not shown). A socket member 410 is secured to the upper end 181', and ball member 401 may rotate and pivot with respect to socket member 410. Hydraulic fluid tubing 258, or electrical wiring 258' may pass through shaft member 402 and socket member 410, in the manner previously described. The amount of desired movement of ball member 401 with respect to socket member 410 may be varied based upon the size of the opening 411 in socket member 410, through which shaft 402 passes and/or the angular configuration of the wall surface 412 of opening 411. The larger the opening 402 and/or the greater the angular configuration of wall surface 412, the more movement which is permitted between ball member 401 and socket member 410. Dependent upon the size of the opening 411 and angular configuration of wall surface 412, the range of motion of shell 141 with respect to strut members 180', 181" via socket member 410 may be limited, preferably to that of normal anatomical head and neck movement. Thus, the sizing of opening and its angular configuration, or alternatively the sizing of the shaft 402, serves as a stop or abutment to limit the range of motion of strut members 180', 180", as shaft 402 abuts against wall surface 412.

Figure 17:
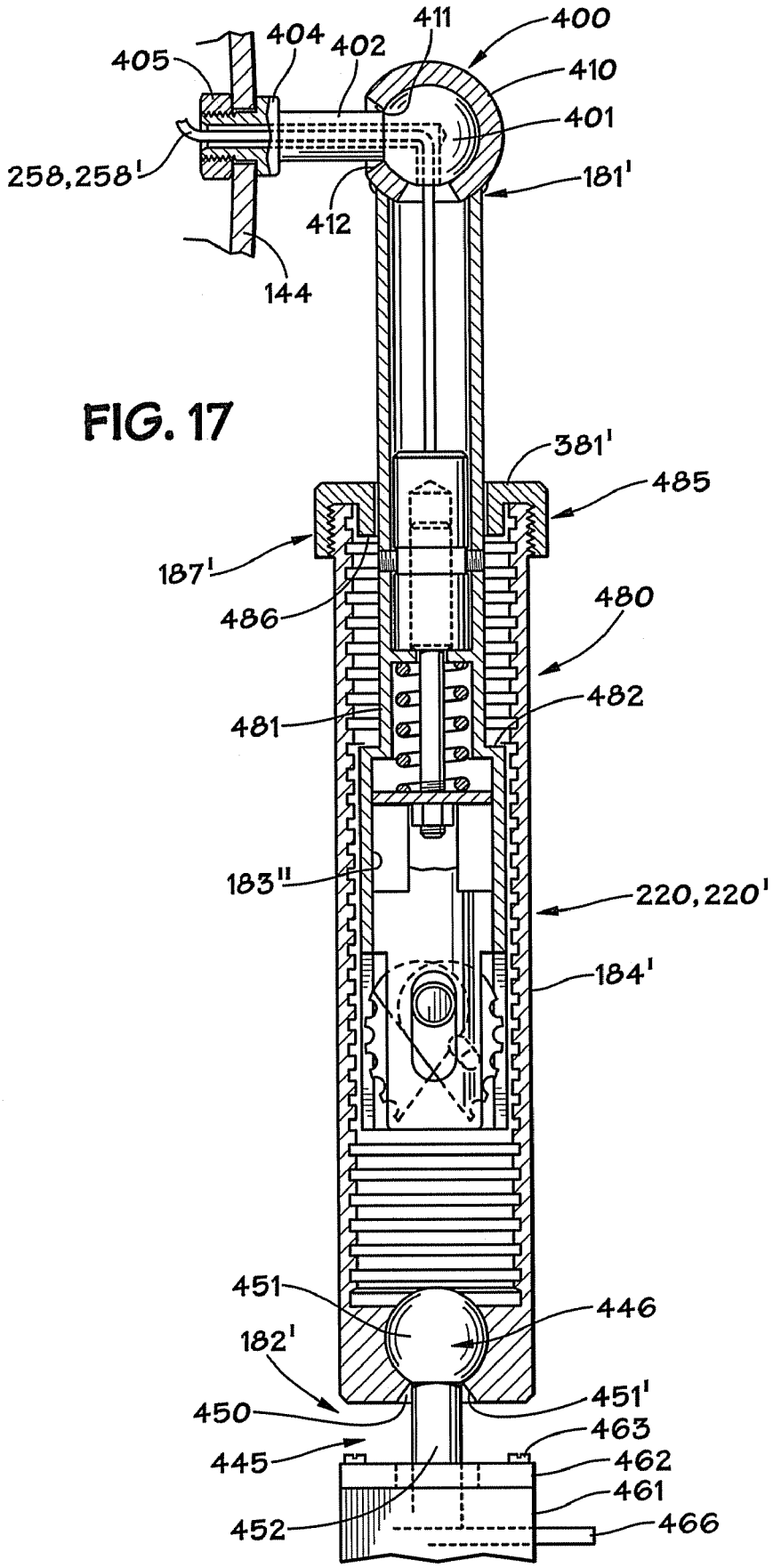
FIG. 17 is a partial cross-sectional view of another embodiment of a portion of a motion restrictor device.

With reference to FIGS. 14, 15, and 17 the second ends 182' of each strut member 180', 180" may include a connection assembly 440 which connect the second ends 182' of each strut member 180', 180" to harness assembly 200 previously described. The connection assemblies 440, for the lower ends 182' of the strut members 180', 180" associated with the side walls 143, 144 of shell 141 may include a rotatable and pivotable connector 445, whereby the second ends 182' of the strut members 181', 180" may both rotate and pivot with respect to harness assembly 200. Preferably, as shown in FIGS. 14, 15, and 17, the rotatable and pivotable connector 445 may be a ball and socket connector 446 that permits the desired rotation and pivoting of the second end 182' of strut member 180', 180" with respect to harness assembly 200. Ball 451 is attached to shaft member 452 associated with harness member 200, as will be hereinafter described. By varying the size of opening 450 and/or the angular disposition of the wall surface 451 of opening 450 in the lower end 182' of strut members 180', 180", the amount of pivoting of strut member 180', 180" with respect to harness 200 may be limited. The larger the opening 450, and/or the greater the angular disposition or configuration of wall surface 451, the greater the amount of movement of shaft member 452 with respect to the lower end 182' of strut members 180', 180". Similarly, the smaller the size of opening 450 and/or the lesser the angular disposition, the less the amount of relative movement permitted, when shaft 452 abuts against the wall surface 451 of opening 450. Thus, the size and/or angular disposition of opening 450 serves as a stop or abutment to limit the range of motion of strut members 180', 180". Preferably, the upper ends 181' of strut members 180', 180" associated with each of the side walls 143, 144 of shell 141 are attached to each side wall 143, 144 at a location which substantially corresponds to the atlanto-occipital junction of the person 152 wearing the helmet 140.

Figure 16:
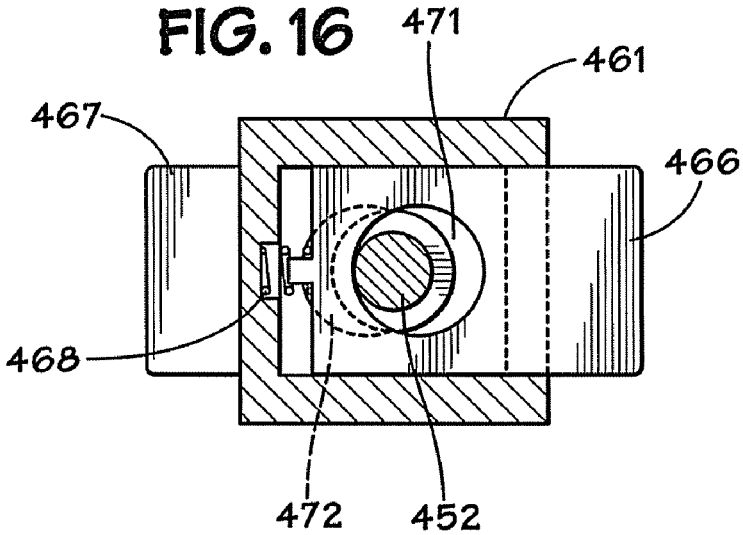
FIG. 16 is a partial cross-sectional view taken along line 16-16 of FIG. 15.

With reference to FIGS. 14-16, a quick-disconnect assembly 460 for strut members 180', 180" (FIG. 17) is illustrated. Housing 461 is secured to harness 200 in any desired manner. Housing 461 receives shaft 452 of connector 445. The lower end of shaft 452 is provided with two outwardly extending flanges, or enlarged portions, 453, 454. Housing 461 has a cover member 462 associated with housing 461, as by screws 463 and cover member 462 has an opening 465 having a size large enough to permit flanges 453, 454 to pass therethrough. Disposed within housing 461 are two spring-biased abutment plates 466, 467, biased by springs 468, 469, which bias abutment plates 466, 467, into the positions shown in FIGS. 15 and 16, whereby abutment plates 466, 467, abut flanges 453, 454, to restrain and secure shaft 452 in the position illustrated in FIG. 15. By applying a force, as by a person squeezing abutment plates 466, 467, in the direction shown by arrows 470, the abutment plates are moved, whereby the openings 471, 472 in abutment plates 466, 467 are moved to permit shaft 452, including flanges 453, 454, to pass through openings 471, 472. In this manner, strut members 180', 180", may be quickly and easily either associated with harness 200, or removed, or disassociated, from harness 200.

With reference to FIG. 17, strut 180" is illustrated, and it generally has the same construction as strut 180' illustrated in connection with FIGS. 14-16. Strut member 180" generally differs from the previously described strut member 180', in that strut member 180" is provided with a stop, or abutment, assembly 480 which limits the amount of upper movement of the first member 183" with respect to the second, or second tubular, member 184'. The first member 183" differs slightly in construction from member 183' in that there is a reduced diameter portion 481 provided on first member 183", and the reduced diameter portion 481 provides an abutment surface, or inwardly projecting ledge, 482. The outer surface of the first end 187' of second tubular member 184' is threaded to threadedly received a cap member 381', which in addition to permitting assembly of the first member 183" and second member 184', includes a downwardly depending abutment member 485, which may take the form of a downwardly extending annular flange 486. The location of abutment member 485 with respect to abutment surface 482 determines the amount of upward travel of first member 183" with respect to second member 184'. Thus, the range of motion of strut members 180" in an upward direction is limited to that of normal anatomical head and neck movement even when the locking assemblies 220, 220' are not engaged. Once abutment surface 482 contacts abutment member 485, further upward movement of first member 183" is restrained. In addition to selecting the location of abutment surface 482 on first member 183", further adjustments to the range of upward movement may be provided by threading cap member 381' upwardly or downwardly with respect to the second member 184', which in turn moves the abutment member 485 in a corresponding upward or downward distance.

Another embodiment of the present invention is that instead of or in addition to a force sensor connected to or adjacent to the shell of the helmet 141, an acceleration sensor can also be connected to or adjacent to the shell of the helmet or connect to or adjacent to another object that is connected to the helmet. The acceleration sensor may be one of many different types of readily available accelerometers in the marketplace. In this embodiment the acceleration sensor can detect acceleration of the helmet in a single or in multiple axes or planes of travel. Upon acceleration of the helmet in one or more planes of travel, measured by the acceleration sensor, that exceeds a predetermined amount or rate of acceleration, the locking mechanisms in each of the at least one strut members are activated and lock, stopping substantially all of the telescoping motion of the two ends of each strut member with respect to the opposite end of that strut member. The acceleration sensor is in electrical communication with the locking mechanism in each of the at least one strut members. With the acceleration sensor associated with the actuation system of the present protective helmet, acceleration can be detected in single or in multiple axes or planes of helmet motion and the activation system can have differing threshold amounts or threshold rates of acceleration for each axis or plane of travel of the helmet above which the locking mechanisms in each of the at least one strut members are activated. The force sensor and/or the acceleration sensor may also be made to communicate wirelessly with the locking mechanism in each of the at least one strut members through use of radio waves or other waves on the electromagnetic spectrum with a transmitting device associated with the force sensor and/or acceleration sensor and a receiving device associated with the locking mechanism in each of the at least one strut members. A receiving device on the sidelines of a playing field or track may also be used to receive information from the transmitting device associated with the protective helmet and may be used to monitor the amount of force, amount of acceleration and/or rate of acceleration of the helmet worn by the player, driver or rider by another individual such as a couch or medical professional.

Another embodiment of the cam-like locking mechanism previously described that locks each of the at least one strut members upon sufficient force, sensed by the force sensor, or sufficient acceleration, sensed by the acceleration sensor, each at least one strut members may form a sealed container of fluid with the second tubular member (analogous to 184') receiving the first tubular member (analogous to 183'). In this embodiment a cap member (analogous to 381') seals the fluid within the second tubular member (analogous to 184') with the second end (analogous to 186) of the first tubular member forming a piston-like, cylinder shaped structure that is sealingly received within the second tubular member. The inner wall of the second tubular member is smooth, without any ridges, in this embodiment and allows movement of the first tubular member up and down within the second tubular member and the piston-like aspect of the first tubular member has a seal that touches the inner aspect of the second tubular member so fluid can not travel around the piston-like structure of the first tubular member. Valves present in the piston-like structure at the second end (analogous to 186) of the first tubular are oriented to allow free movement, when the valves are open, of fluid back and forth from one side of the piston-like structure to the other, and thus allow free telescoping motion of the first and second tubular members. The valves in the piston-like structure remain open until the activation system, due to force, sensed by the force sensor, above a predetermined threshold amount or an acceleration, sensed by an acceleration sensor, above a predetermined threshold amount or rate of acceleration, sends an electrical signal down a wire that travels down the middle of the first tubular member and connects to the valves. The electrical signal closes the valves in the piston-like structure and thus stops the fluid moving through the valves to the opposite side of the piston structure. By stopping the fluid movement through the valves of the piston-like structure, the telescoping movement of the first and second tubular members is arrested until the valves are re-opened. Valve re-opening corresponds to the removal of the force on the helmet that was above the predetermined threshold or acceleration of the helmet falling below the predetermined threshold amount of or rate of acceleration. Alternatively, rather than having valves within the piston-like structure, the piston-like structure may be made without any holes or valves in it and a pipe like structure connecting the first end (analogous to 187') of the second tubular member (analogous to 184) to the second end (analogous to 188') of the second tubular member and communicating at both ends with the fluid filled compartment of the second tubular member. Within this pipe-like structure a valve may be located that when the valve is open allows free movement of the fluid back and forth from one side of the piston-like structure, through the pipe-like structure to the other side of the piston-like structure until the activation system, when a force above a predetermined amount is sensed by the force sensor or an acceleration above a predetermined amount of or rate of acceleration is sensed by the acceleration sensor, sends an electrical current down a wire to the valve and closes the valve in the pipe-like structure. With the valve closed, telescoping movement of first and second tubular members is arrested because the fluid can no longer move freely from one side of the piston-like structure to the other side of the piston-like structure, and the valves are re-opened when the force or acceleration falls below the predetermined threshold amount or rate.

In another alternative embodiment, the piston-like structure at the second end of the first tubular structure has holes in it that are permanent and do not change and with telescoping motion of the first and second tubular members the fluid flows freely through the holes to the other side of the piston-like structure. An electrical current or voltage can be applied by the activation system to certain available hydraulic fluids contained within the sealed strut member. These certain hydraulic fluids increase their viscosity when an electrical current or voltage is applied to them and the fluid is no longer able to pass freely through the holes that are in the piston-like structure of the first tubular member to the other side of the piston-like structure. Because the fluid is no longer able to pass through the holes in the piston-like structure the telescoping motion of the first and second tubular members is substantially stopped until the electrical current or voltage is removed. The application of the electrical current or voltage by the activation system corresponds to a force, sensed by the force sensor in the helmet, above a predetermined threshold amount or an acceleration, sensed by the acceleration sensor in the helmet, above a predetermined amount or rate of acceleration, and the removal of this electrical current or voltage corresponds to the removal of the force or the acceleration falling below the predetermined threshold amount or rate. The electrical current or voltage is produced when the activation system completes an electrical circuit that is in connection with a source of electricity, for example a battery or a capacitor.

Optionally, the second tubular structure may contain magnetic rheological fluid wherein applying a magnetic field to the fluid increases fluid viscosity. In one embodiment, the activation system activates an electromagnet (not shown) is response to a sensed force or acceleration. The activated electromagnet sufficiently increases the magnetic rheological fluid viscosity to thereby arrest or significantly hinder telescoping motion between the first and second tubular members as described above. Once the magnetic field is removed from the magnetic rheological fluid, the telescoping movement of the first and second tubular structures once again is allowed as the fluid moves freely from one side of the piston-like structure to the opposite side of the piston-like structure.

Figure 18:
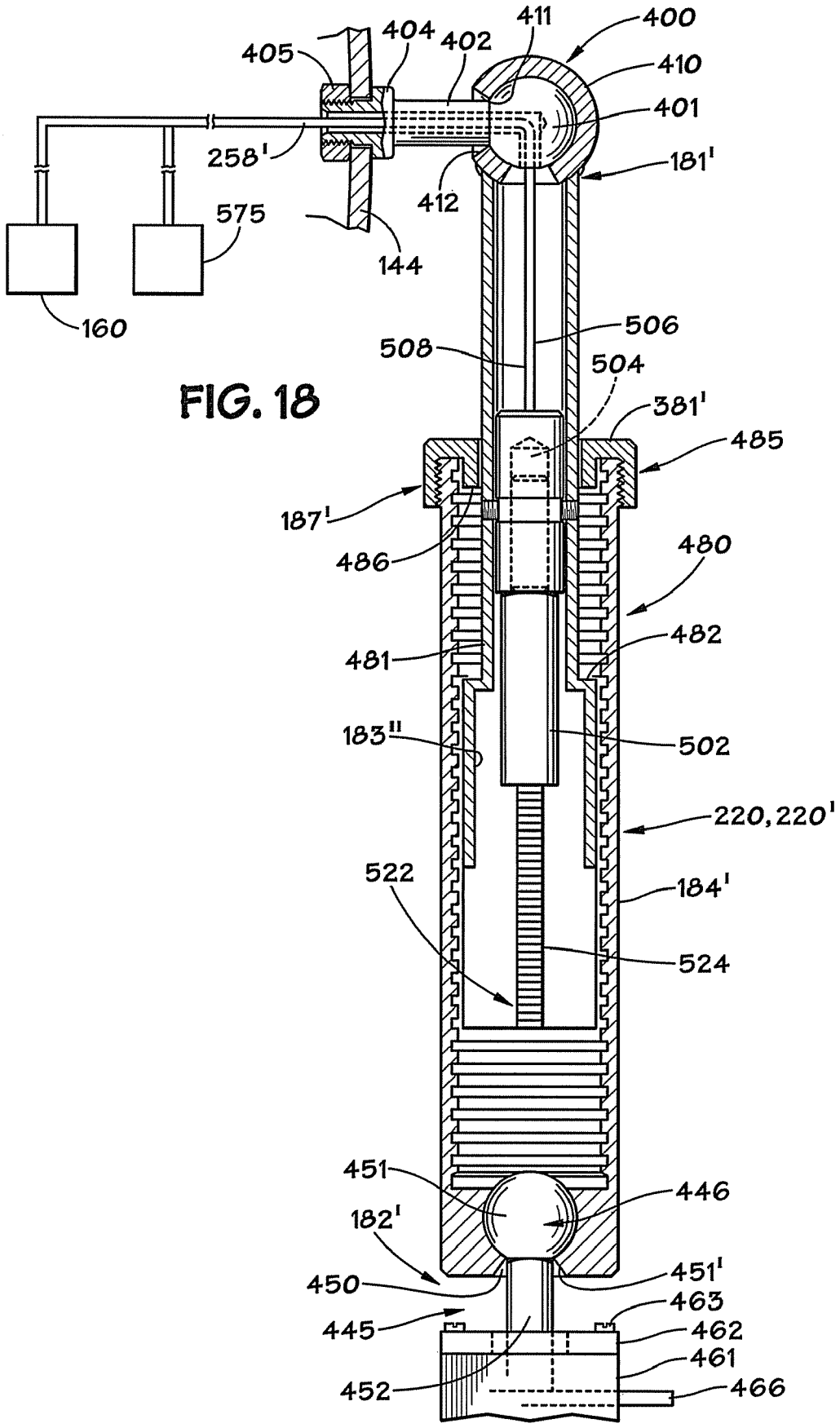
FIG. 18 is a partial cross-sectional view of another embodiment of a portion of a motion restrictor device.

With reference now to FIG. 18, a side partial cutaway view of an alternative arresting system is provided. The system comprises a latch assembly 502 disposed within the first tubular member 183" and affixed thereto. A rack 522 is provided and secured on a lower end within the second tubular member 184', the rack 522 includes teeth 522 on a surface facing the latch assembly 502. Mechanically connected to the latch assembly 502 is a latch actuator 504 operational to couple the latch assembly 502 to the rack 522 thereby arresting movement between the first tubular member 183" and the second tubular member 184'. Signal leads (506, 508) allow sensor input to the latch actuator 504. The sensor input may be from the force sensor 160, an acceleration sensor 575, or both. During normal use when the first tubular member 183" telescopingly moves in and out of the second tubular member 184" the latch assembly 502 travels freely over the rack 522. However, in one example of use, upon a threshold force or acceleration as described above, a signal from the sensor is transmitted via one of the leads (506, 508) to the latch actuator 504 for coupling the latch assembly 502 to the rack 522. Optionally, instead of a rack 522 provided in the second tubular member 184', the teeth 524 may be formed directly on the second tubular member 184' inner circumference.

Figure 19:
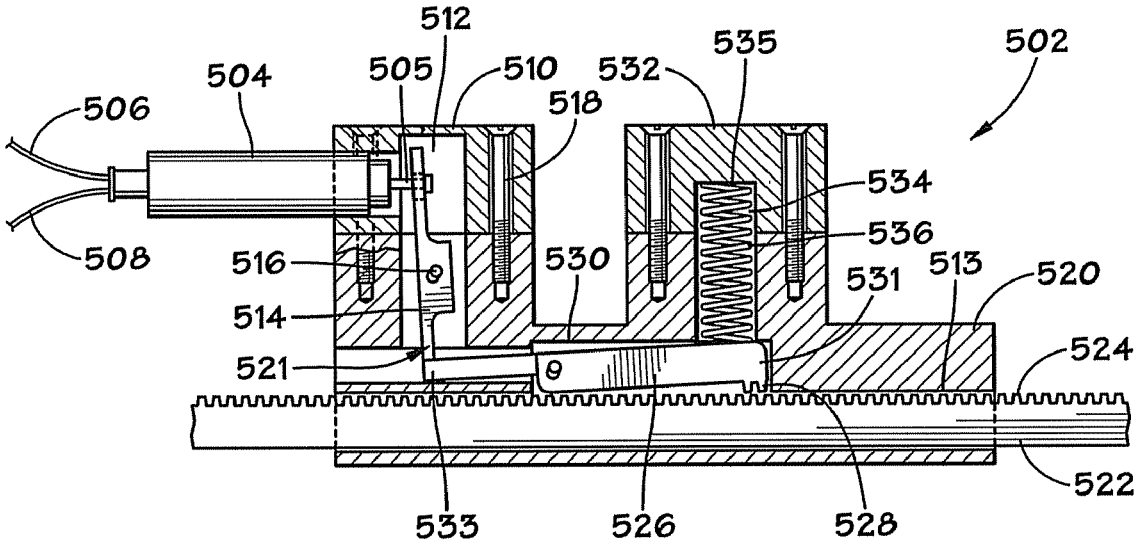
FIG. 19 is a partial cross-sectional view of a portion of the motion restrictor device of FIG. 18.

An embodiment of the latch assembly 502 in illustrated in FIG. 19 in a side partial sectional view. In this embodiment the latch actuator 504 comprises a solenoid anchored on one end in a pivot bar housing 510 with signal leads (506, 508) connected on the solenoid end opposite the housing 510. The pivot bar housing 510 is mounted on a rack housing 520 as shown by fasteners 518. A cavity 512 is provided in the pivot bar housing 510 that extends to a corresponding cavity 513 in the rack housing 520. In the embodiment shown, the pivot bar housing 510 and the rack housing 520 are oriented generally normal to each other. A pivot bar 514 is pivotingly suspended within the pivot bar cavity 512. In this view, the pivot bar 514 is generally perpendicular to the rack housing 520 and rack housing cavity 513. A pivot bar pin 516 extends through the pivot bar 514 and opposite sides of the pivot bar housing 510. Preferably, the pivot bar pin 516 is disposed perpendicular to the latch assembly 502 elongate length, however other pivot bar pin 516 orientations exist.

The rack 522 extends through the rack housing cavity 513 oriented generally parallel to the latch assembly 502 elongate length. Also provided in the rack housing cavity 513 is a latch bar 526 shown having a lever end 533 in contact with actuating end 521 of the pivot bar 514 and a latching end 531 between the rack 522 and spring 536. The latch bar 526, which is a generally elongate member aligned with the rack 522, includes teeth 528 on the latching end 531. The teeth 528 are on the side of the latch bar 526 proximate to the rack 522 and formed to engage the teeth 524 on the rack 522.

Figure 20:
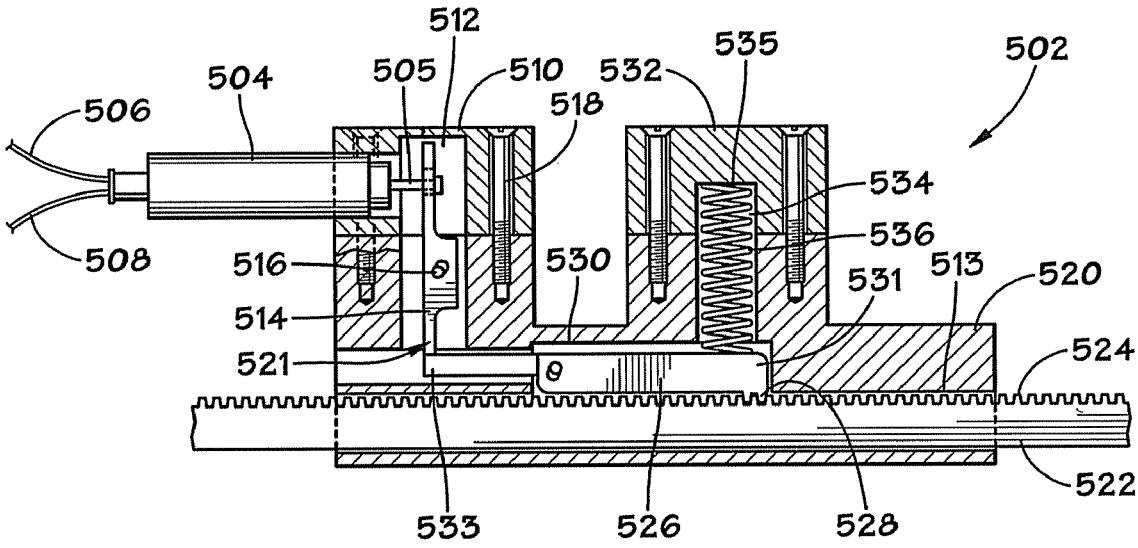
FIG. 20 illustrates the portion of FIG. 19 in a latched position.

The spring 536 extends from the latching end 531 in the opening 513 into a cylindrical space 534 in a spring housing 532. The space 534 is aligned generally perpendicular to the rack housing 520 elongate length having a closed end 535 within the spring housing 532 and an open end defined by the boundary between the space 534 and opening 513. In FIG. 19, the spring 536 is compressed between a surface of the latching end 531 opposite the teeth 528 and the closed end 535. Contact at the latch bar 526 lever end 533 and pivot bar 514 actuating end 521 prevents the latch bar 526 latching end 531 from pivoting into engagement with the rack 522. FIG. 20 illustrates an example of latching actuation where the latch actuator 504 has received an actuation signal from one of the leads (506, 508) and respondingly drawn inward an attached actuating rod 505 to thereby pivot the pivot bar 514 about its pin 516. Rotating the pivot bar 514 repositions the contact point between the actuating end 521 and lever end 533 and removes rotational resistance on the lever end 533. This allows the spring 536 compressed force to act on the latching end 531 and push the teeth 528 into latching engagement with corresponding teeth 524 on the rack 522 (or formed in the second tubular member inner circumference 184'). Latching engagement between the latch assembly 502 and the rack 522 arrests telescoping movement between the first and second tubular members (183", 184). The force exerted on the helmet is then distributed from the helmet through the strut member(s) to the chest, shoulders and back of the person wearing the device and the risk of cervical spine injury is therefore reduced.

Figure 21:
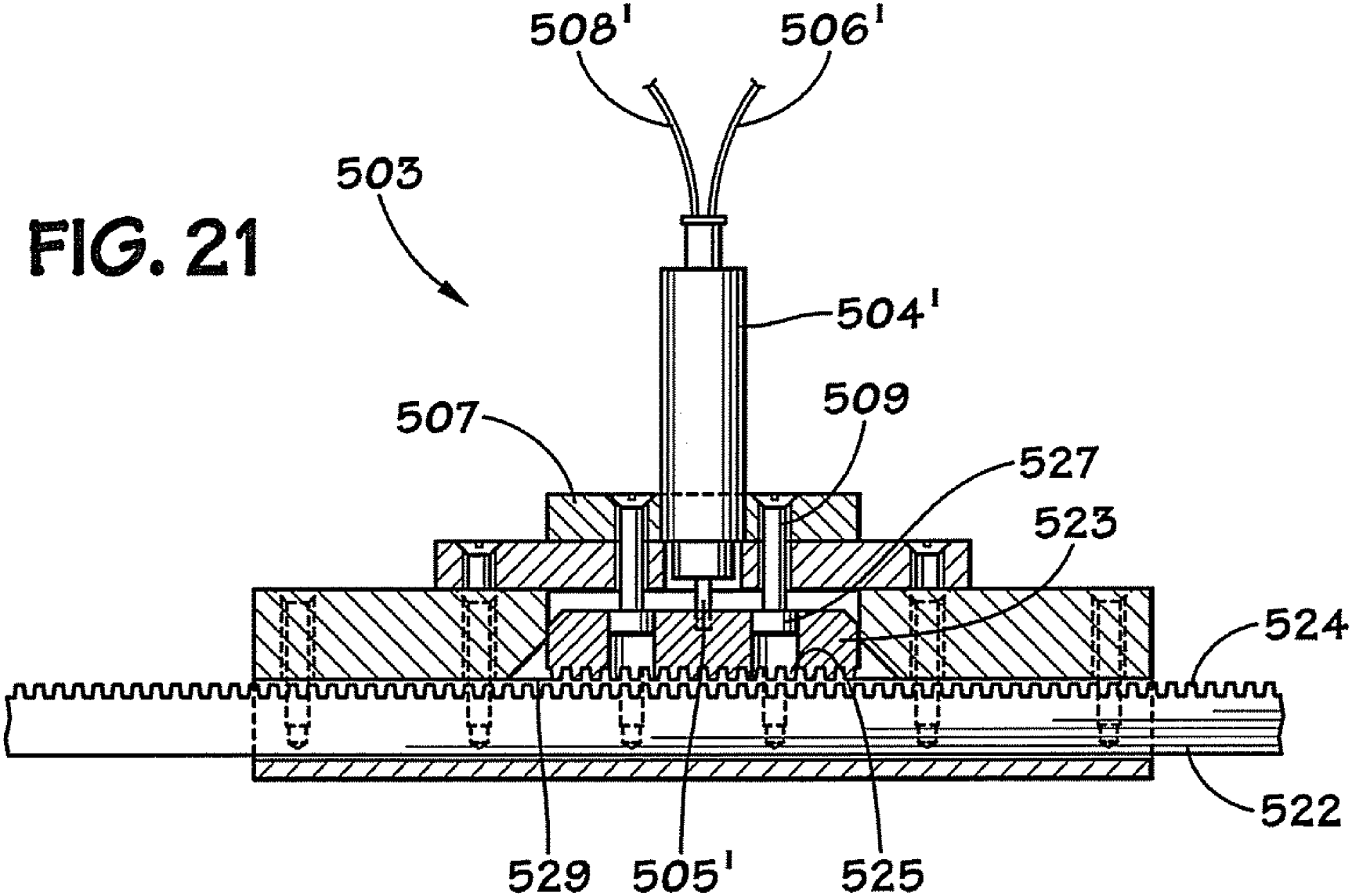
FIG. 21 is a partial cross-sectional view of an alternative portion of the motion restrictor device of FIG. 18.

A perspective partial sectional view of an alternative embodiment of a latching assembly 503 is provided in FIG. 21. This embodiment includes a latch actuator 504' anchored to an elongate housing 507, where the actuator 504' is disposed generally perpendicular to the elongate length of the housing 507 and proximate to the housing 507 mid section. The housing 507 receives a rack 522 with teeth 524 therethrough, where the rack 522 is aligned with the housing 507 elongate section on a side opposite where the actuator 504' is anchored. The teeth 524 are aligned generally towards the actuator 504'. An actuating rod 505' extends from the actuator 504' into the housing 507. A latch rack 523 with teeth 525 on a surface of the latch rack 523 is affixed to the actuating rod 505'. The latch rack 523 is aligned substantially parallel with the rack 522 and the latch rack 523 is oriented so the teeth 525 face the teeth 524 on the rack 522. In FIG. 21, the latch rack 523 is apart from the rack 522 and the rack 522 and latch assembly 503 are moveable with respect to each other in either direction along the rack 522 or latch assembly 503 elongate length. In one example of latching operation, the latching assembly 504' receives an actuating signal or command and urges the actuating rod 505' outward thereby pushing the latch rack 523 against the rack 522. Continued pushing on the latch rack 523 ultimately engages the teeth 529 on the latch rack 523 with the teeth 524 on the rack 522 to engage the latch rack 523 and rack 522 to arrest respective movement between the first and second tubular members (183", 184'). It should be pointed out that other embodiments exist where the rack 522 is attached to the first tubular member 183" and the latch assembly (502, 503) is attached to the second tubular member 184'.

Figure 22:
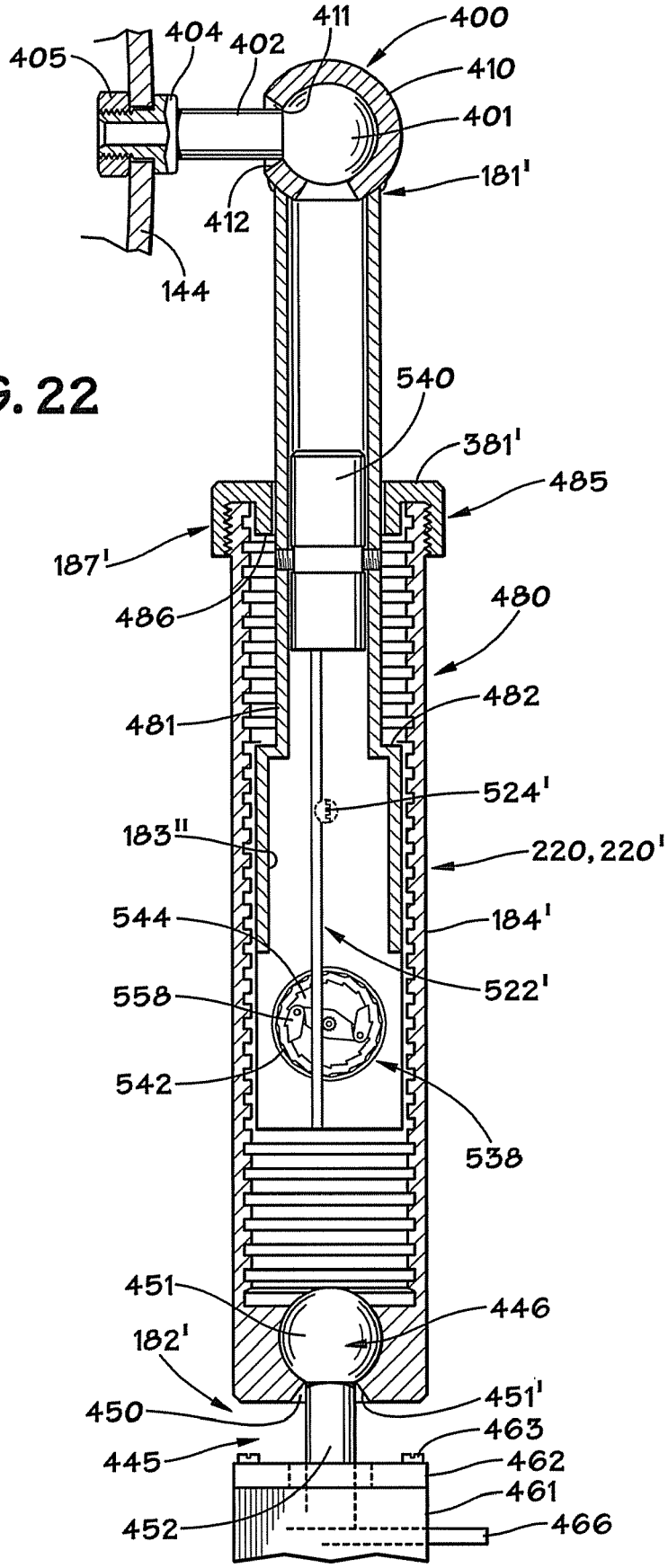
FIG. 22 is a partial cross-sectional view of another embodiment of a portion of a motion restrictor device.
Figure 23:
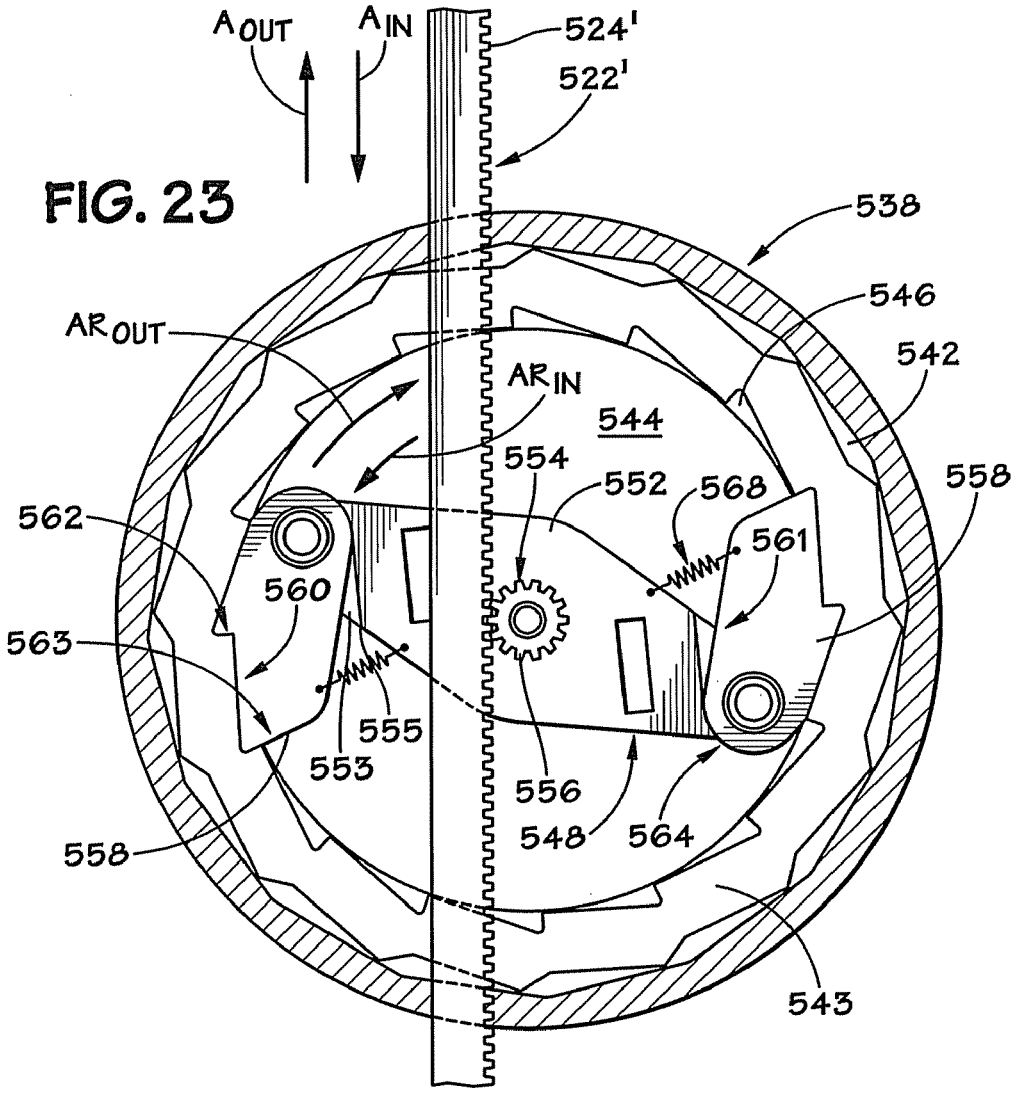
FIG. 23 is an overhead view of a partial cross-sectional view of a portion of the motion restrictor device of FIG. 22.

FIGS. 22 and 23 illustrate an embodiment of a strut arresting system activatable on tubular member respective movement; with this embodiment there is no force sensor or acceleration sensor associated with an activation system. This embodiment contains a centrifugal brake mechanism associated with each of the at least one strut members in a rack and pinion formation. With reference now to FIG. 22, an embodiment of a centrifugal brake mechanism is provided in a side partial sectional view. Attached to the second tubular member 184' is a centrifugal brake assembly 538 engaged with a rack 522'. The rack 522' is anchored on one end to a mount 540.

An overhead view of an example of a centrifugal brake assembly 538 is illustrated in FIG. 23. The centrifugal brake assembly 538 comprises a disk like base 542 having a recess 544 formed into an outer planar side defining an annular surface 543 between the recess 544 outer periphery and the base 542 outer circumference. A series of wedge or triangular shaped indentations 546 are provided along the recess 544 outer periphery that extend up to the annular surface 543. A centrifugal engaging assembly 548 is disposed in the recess 544, the centrifugal engaging assembly 548 comprises a connecting rod 552 attached to the recess 544. In the embodiment shown, the connecting rod 552 midsection is proximate to the recess 544 midsection. The connecting rod 552 is rotatable about its midsection within the recess 544 and includes oppositely disposed ends extending outward and proximate to the recess 544 outer periphery. The connecting rod 552 includes a recessed area 553 on each end with a ledge 553 defining the recessed area 553 border. Pawls 558 are pivotingly connected at a pivot connection 564 onto each recessed area 553. Each pawl 558 outer lateral side 560 is proximate to the recess outer periphery and the indentations 546. The lateral sides 560 include a profile 562 formed thereon shaped to engage the indentations 546. The pawls 558 also include a front side 563 on an end opposite the pivot connection 564, the lateral side 560 and front side 563 are tapered such that the edge where they meet also is shaped to engage the indentations 546.

A pinion gear 554 is affixed on the connecting rod 552, preferably on its midsection. The pinion gear 554 includes teeth 556 on its outer circumference substantially aligned with the pinion gear 554 axis. The rack 522' spans slightly above the centrifugal brake assembly 538 and is illustrated offset from the base 542 midpoint. The rack 522' teeth 524' are shown engaging the pinion gear 554 teeth 556 thereby coupling the rack 522' (and first tubular member 183") to the centrifugal brake assembly 538 (and second tubular member 184'). Inward telescoping movement between the first and second tubular members (183", 184') creates relative translational movement between the rack 522' and the centrifugal brake assembly 538 illustrated by arrow $A_{IN}$. By virtue of the rack 522' and gear pinion 554 coupling, the inward telescoping movement rotates the centrifugal engaging assembly 548 in a direction denoted by arrow $A_{RIN}$. Similarly, arrows $A_{OUT}$ and $A_{ROUT}$ illustrate relative translational movement and rotational movement resulting from outward telescoping movement between the first and second tubular members (183", 184').

The pawl 558 outer lateral side 560 configuration does not engage the indentations 546 when the centrifugal engaging assembly 548 is rotated in the $A_{ROUT}$ direction. The centrifugal engaging assembly 548 can also be rotated in the $A_{RIN}$ direction without pawl 558/indentation 546 engagement if the pawls 558 are situated so their inner lateral sides 561 are aligned with or proximate to their respective ledges 555. However, if the first tubular member 183" moves into the second tubular member 184', as described above, with sufficient force or acceleration, the resulting rotational velocity in the $A_{RIN}$ direction imparts a centrifugal force that pivots the latching profile 562 and front side/lateral side (563 562) edge of the pawls 558 into engagement with the indentations 546 as shown in FIG. 23. Thus inertia of the pawls 558 allows rotation in both the $A_{ROUT}$ direction $A_{RIN}$ direction but will prevent rotation in the $A_{RIN}$ direction when first and second tubular member (183", 184') inward movement surpasses a threshold velocity or acceleration.

With the rotational movement of the circular gear stopped, the telescoping movement of the first and second tubular structures is also stopped. The centrifugal brake assembly 538 engagement thus redistributes forces from a helmet to the second tubular member 184' and through the at least one strut member to a corresponding shoulder harness, thus decreasing the risk of cervical spine injury. The centrifugal break can be engineered to either stay locked after one activation, or to release and allow the circular gear to turn freely once the threshold force, velocity, or acceleration on the helmet is no longer present.

Optionally, a spring 568 or other resilient member may be employed to retain the pawls 558 adjacent the ledge 555 until a threshold velocity or acceleration is experienced. It is within the capabilities of those skilled in the art to properly sized and/or weighted components suitable to accomplish arresting engagement using centrifugal force corresponding to a threshold force, velocity, or acceleration. Alternatively, instead of a rack 522', grooves corresponding to the teeth 556 can be provided directly onto the first tubular member 183". As a variation of this embodiment, the centrifugal brake assembly 538 can be attached directly to the helmet, thus precluding the need for the first tubular member of the strut.

Figure 24:
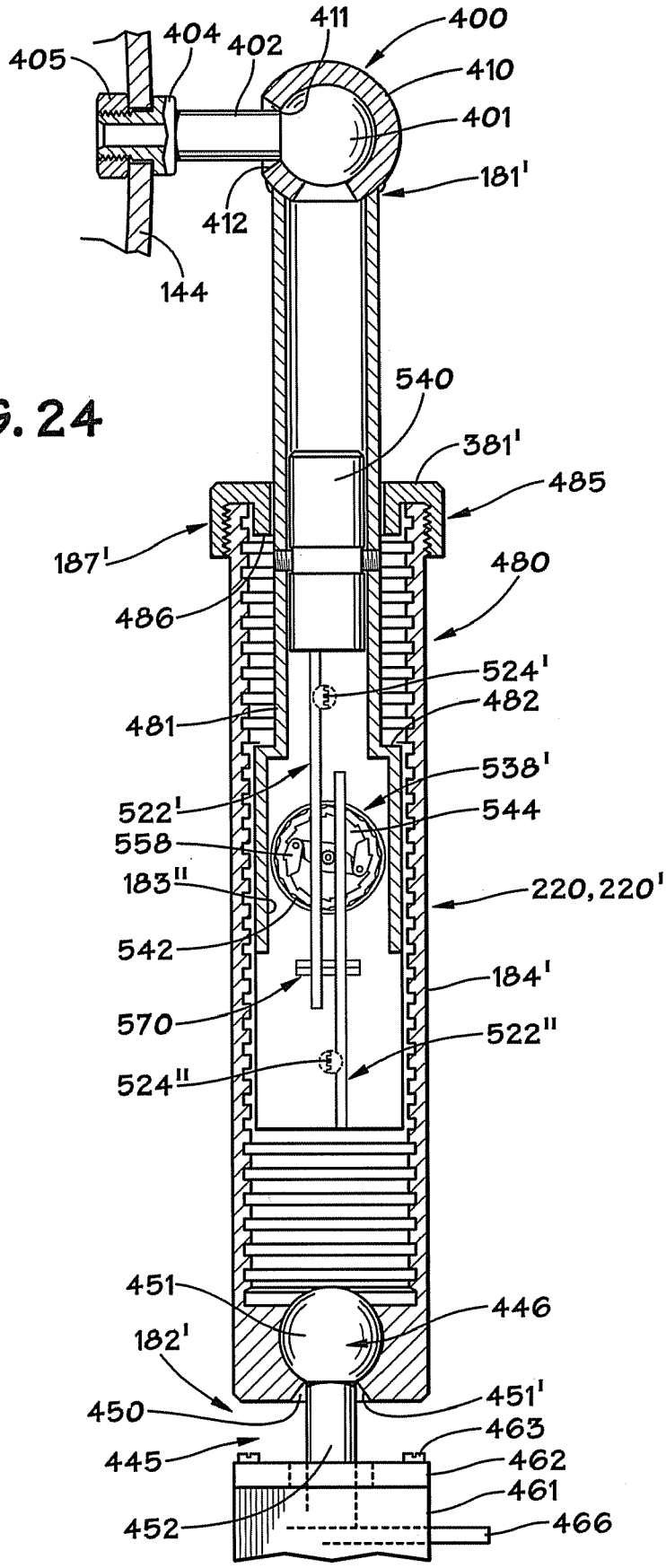
FIG. 24 is a partial cross-sectional view of another embodiment of a portion of a motion restrictor device.

An additional embodiment of a centrifugal engaging system is depicted in FIG. 24 in a side partial sectional view. Here two racks (522', 522") are connected respectively to the first and second tubular members (183", 184'). Thus in and out telescoping motion of the first tubular member 183" with respect to the second tubular member 184' causes a reciprocating motion between the rack 522' and rack 522". The teeth (524', 524") of both racks (522', 522") engage the pinion gear 544 gear teeth 556. An alignment bracket 570 may be included having openings through which the racks (522', 522") can freely axially travel but maintains each rack (522', 522") a set distance apart.

By using an inertia-based system such as the centrifugal break system, when the head is accelerated by an amount or rate, the inertia-based, brake system engages and the acceleration of the brain is therefore decreased and the risk of brain injury is therefore decreased. The threshold acceleration can occur from impact forces on the helmet or also when no impact force is applied to the helmet but acceleration of the head and helmet occur in reference to the wearer's torso. One example of such a situation occurs when the head is accelerated in reference to the wearer's body during a car wreck when the wearer's torso is restrained by a seatbelt. Similar brain protection can be afforded in other embodiments that include the use of an acceleration sensor and activation system.

Figure 25:
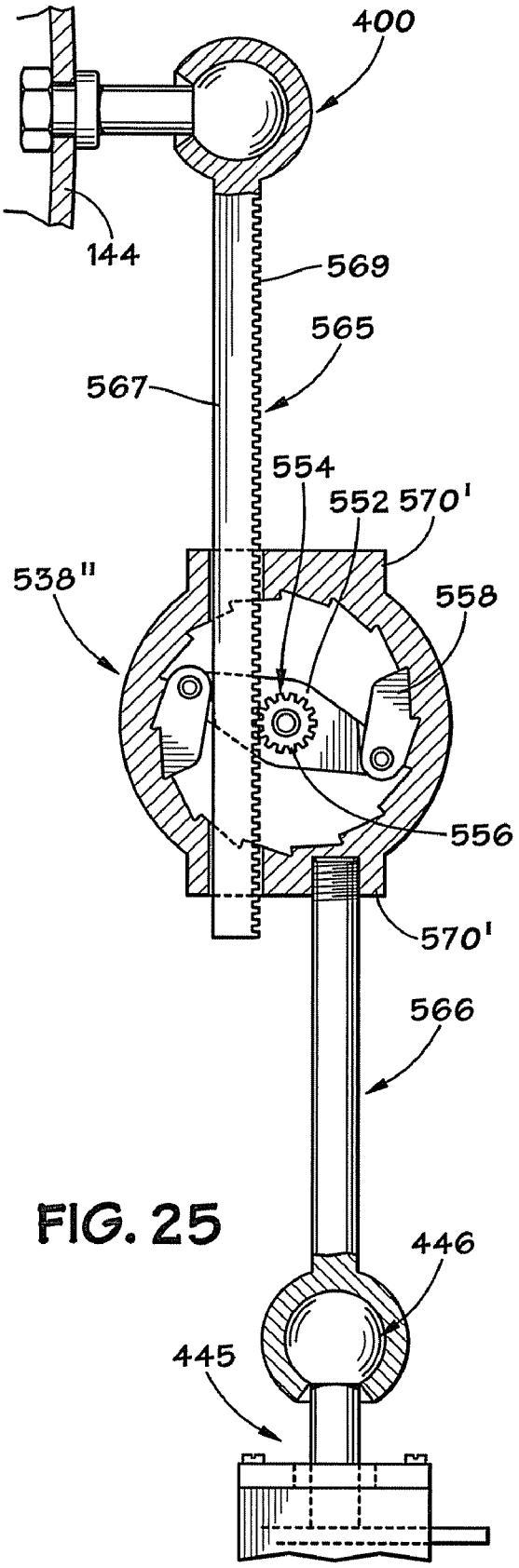
FIG. 25 is a side view of another embodiment of a portion of a motion restrictor device.
Figure 26:
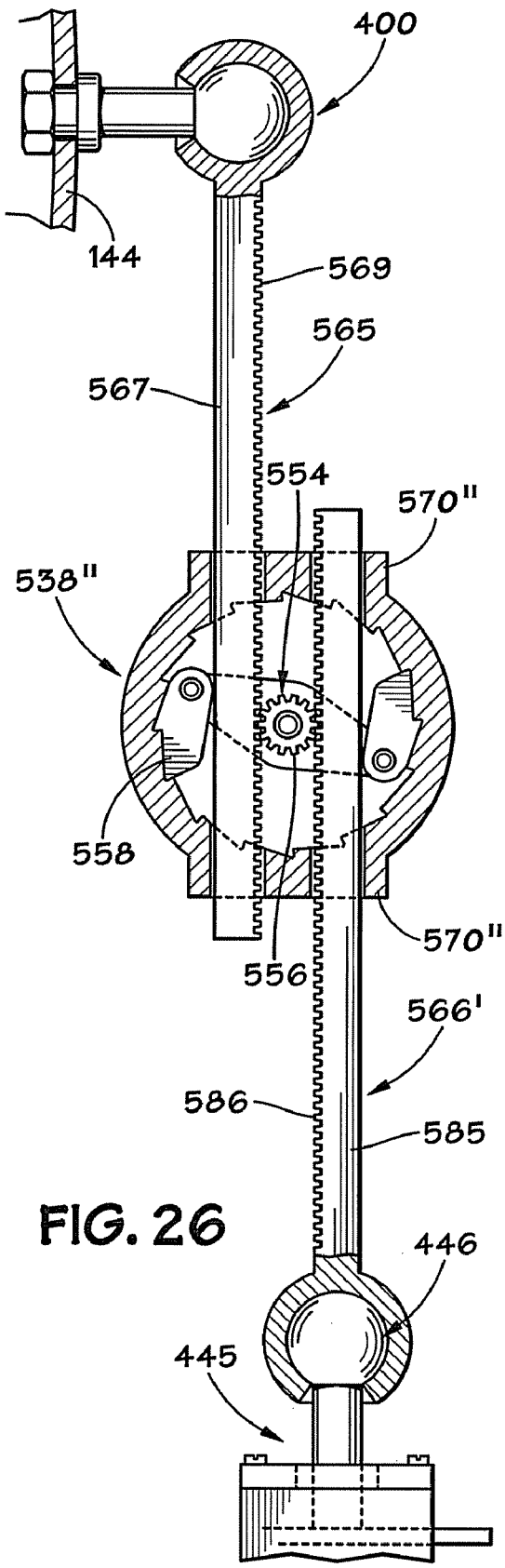
FIG. 26 is a partial cross-sectional view of another embodiment of a portion of a motion restrictor device.

A side view of an alternative centrifugal brake assembly 538" is provided in FIG. 25. A second strut 566 couples on one end to a socket connection 446 and is attached on its other end to the centrifugal brake assembly 538". The socket connection 446 is connected to a harness assembly through its connection with the connector 445. A first strut member 565 extends from the connection assembly 400 and couples on its other end to the centrifugal brake assembly 538". The first strut member 565 comprises a rack 567 having teeth 569 on an outer surface arranged perpendicular to the length. The teeth 569 on the rack 567 engage the pinion gear teeth 556 and as described above, rotate the connecting member 552 upon relative movement of the first strut 565 to the centrifugal brake assembly 538". The first strut member 565 is reciprocatingly inserted into an alignment bracket 570' formed on the centrifugal brake assembly 538". The alignment bracket 570' illustrated provides an axial pathway for pinion 554 engagement. Optionally, as illustrated in FIG. 26, the second strut member 566' may comprise a rack 585 with teeth 586 for engaging the pinion gear 554 as described above. An alignment bracket 570" axially aligns both the first and second strut members (565, 566') for pinion gear 554 engagement.

Figure 27:
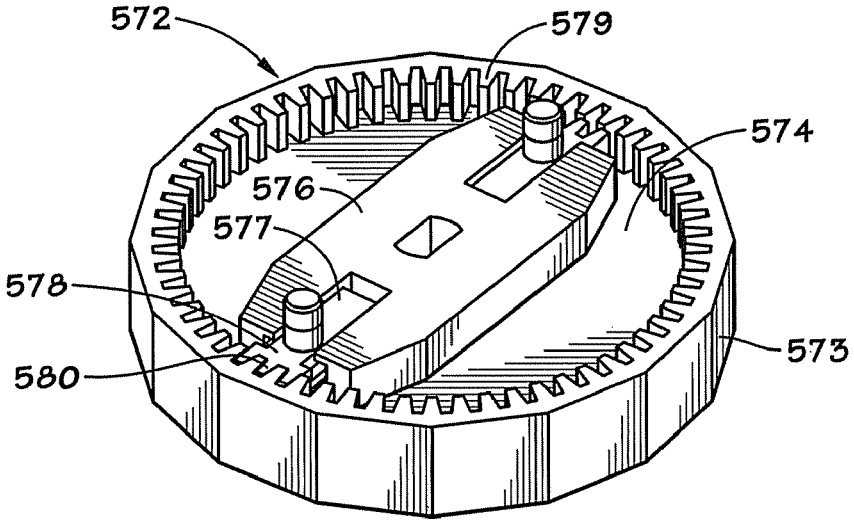
FIG. 27 is a perspective view of an embodiment of a centrifugal brake assembly.

Yet another alternative embodiment of a centrifugal brake assembly 572 is provided in a perspective view in FIG. 27. The assembly 572 comprises a planar base 573 having a recess 574 formed on a planar surface. A connecting arm 576 is pinned within the recess 574 and rotatable about its mid-section. The connecting arm 576 illustrated is generally elongated having slots 577 formed through opposite ends, the slots 577 are generally aligned with the elongate length of the arm 576 and on the elongate ends. Sliding members 578 are provided in the slots 577, where the members 578 are slidable past the elongate ends of the arm 576 and outside of the slot 577. The members 578 have teeth 580 formed on an end oriented away from the arm 576 mid section. As shown in FIG. 27, the members 578 extend partially outside of the slot 577 wherein the teeth 580 on the member 578 engage teeth 579 formed on the outer periphery of the recess 574. When the members 578 are fully disposed in the slot 577 and do not extend past the connecting arm 576 periphery the arm 576 is rotatable within the recess 574. Rotating the connecting arm 576 at a threshold rotational velocity imparts a centrifugal force onto the members 578 to slide them outside of the slots 577 into meshing teeth (579, 580) engagement. Meshing the sliding member teeth 580 with the teeth 579 on the recess 574 locks the connecting arm 576 to the base 573 thereby preventing arm 576 rotation. The threshold rotational velocity corresponds to a force on a wearer or acceleration experienced by a wearer that can cause injury, such as a spinal injury.

Figure 28:
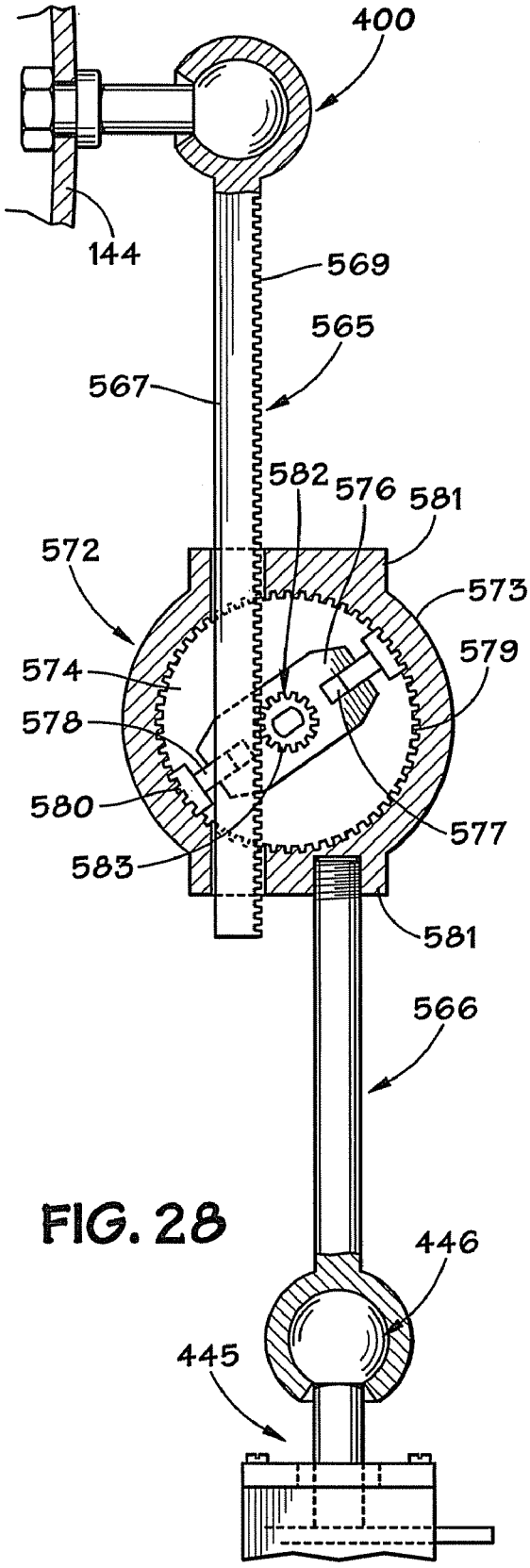
FIG. 28 is a partial cross-sectional view of another embodiment of a portion of a motion restrictor device.
Figure 29:
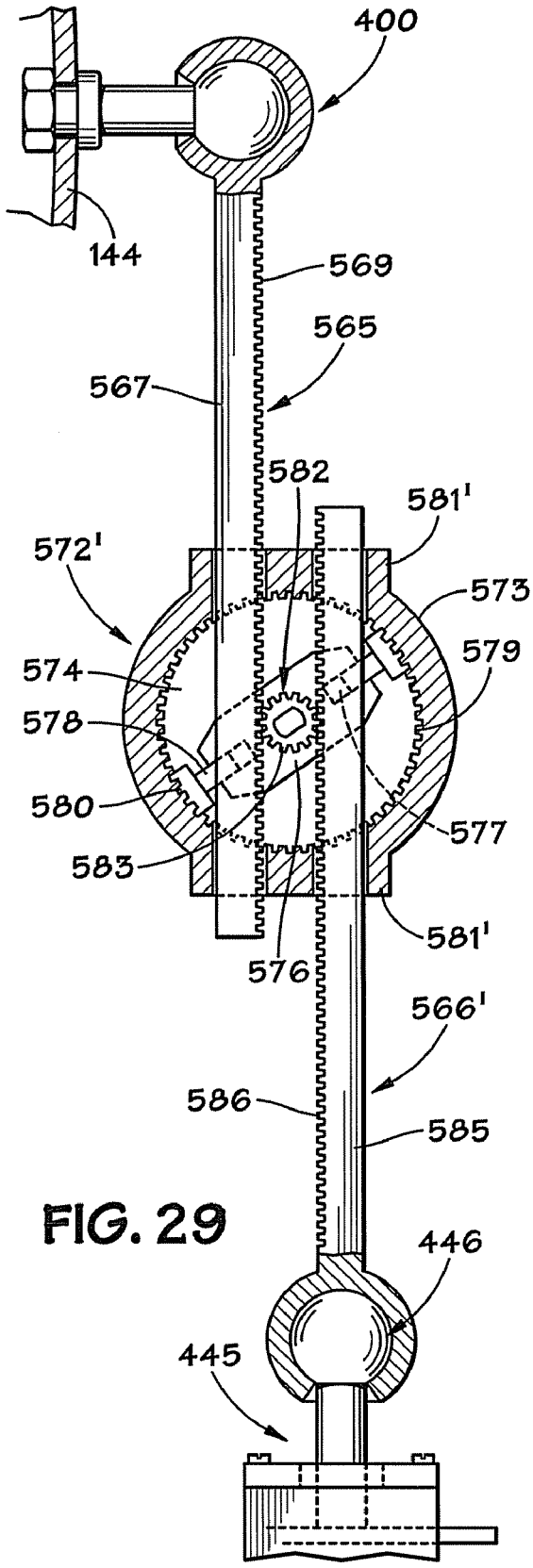
FIG. 29 is a partial cross-sectional view of another embodiment of a portion of a motion restrictor device.

A side view of the centrifugal brake assembly 572 is provided in FIG. 28, where the brake assembly 572 further includes a pinion gear 582 having teeth 583 engaged with teeth 569 on a first strut member 565. The first strut member 565 is shown connected on its other end to the wall 144 of a helmet via a connection assembly. An alignment member 581 aligns the rack 567 for engagement with a pinion gear 582 affixed to the connecting arm 576. A second strut member 566 is affixed to the centrifugal brake assembly 572. As illustrated, the sliding member 578 teeth 580 are engaging teeth 579 on the base 573 thereby arresting first strut motion 565 relative to the second strut 566 thus arresting helmet motion to the harness. Optionally, as illustrated in FIG. 29, the second strut 566' may comprise a rack 585 having teeth 586 for engaging the pinion gear teeth 583. An alignment member 581' is provided to align the racks (567, 585) for engaging the pinion gear 582.

The present invention has been described and illustrated with respect to specific embodiments. It will be understood to those skilled in the art that changes and modifications may be made without departing from the spirit and scope of the invention as. For example, the orientation of the tubular members could be reversed, whereby the lower tubular members could be telescopically received within the upper tubular members. For the purposes of discussion herein, the terms connected, attached and affixed with regard to two or more elements, means the elements are joined, which includes the elements being joined by a separate connecting device.

I claim:

1. A motion restrictor device adapted for use with a protective helmet comprising:

an acceleration sensor adapted to be disposed within the protective helmet;

at least one strut member having first and second ends, the first end of the at least one strut member adapted to be associated with the protective helmet and the second end of the at least one strut member adapted to be associated with a harness assembly;

the at least one strut member permitting relative motion between the first and second ends of the at least one strut member; and a locking assembly associated with the at least one strut member, and the locking assembly, upon an acceleration being sensed by the acceleration sensor having a value at least the value of a threshold acceleration, having a first locked configuration stopping substantially all relative motion between the first and second ends of the at least one strut member.

2. The motion restrictor device of claim 1, wherein the at least one strut member comprises first and second tubular members, the first tubular member being telescopically received within the second tubular member for relative motion between the first and second tubular members wherein the locking assembly is disposed within the at least one strut member, and includes at least one wedge member engageable with an interior wall surface of one of the tubular members to substantially prevent relative motion between the first and second tubular members.

3. The motion restrictor device of claim 2, wherein the locking assembly is associated with the first tubular member, and the second tubular member has a plurality of grooves formed in the interior wall surface of the second tubular member, the at least one wedge member engageable with at least one of the plurality of grooves.

4. The motion restrictor device of claim 3, including an actuation system associated with the acceleration sensor and the locking assembly, the actuation system, upon an acceleration being sensed by the acceleration sensor having a value at least the value of a threshold acceleration, actuates the locking assembly to cause the at least one wedge member to engage the interior wall surface of one of the tubular members.

5. The motion restrictor device of claim 1, wherein the at least one strut member comprises first and second tubular members, the first tubular member being telescopically received within the second tubular member for relative motion between the first and second tubular members wherein the locking assembly is disposed within the at least one strut member, and includes an actuatable latching system engageable with one of the tubular members to substantially prevent relative motion between the first and second tubular members.

6. The motion restrictor device of claim 5, wherein the locking assembly is associated with the first tubular member, and the second tubular member includes profiles for engagement with the latching system.

7. The motion restrictor device of claim 6, wherein the profiles are selected from the group consisting of grooves formed on the second tubular member inner surface and teeth on the second tubular member inner surface.

8. A motion restrictor device for use with a protective helmet for use by an individual comprising:

a harness wearable by the helmet user;

a strut assembly attached on one end to the helmet and on the other end to the harness, the assembly comprising first and second elongated members axially slideable with respect to one another in response to relative movement between the helmet and the harness; and a centrifugal brake assembly coupled to the first and second elongated members and responsive to a threshold rate of movement between the helmet and the harness to arrest relative movement of the first and second elongated member, and to arrest helmet movement relative to the harness and to distribute loads from the helmet to the harness.

9. The motion restrictor of claim 8, wherein the centrifugal brake assembly comprises a base member having a planar surface, a recess formed within the planar surface having indentations on the recess outer periphery, an elongated connecting member in the recess affixed with a pin and rotatable about the pin, and a pawl pivotingly coupled to an end of the connecting member.

10. The motion restrictor of claim 9, wherein the coupling between the brake assembly and the first elongated member rotates the connecting member in response to movement between the first and second elongated members and wherein the pawl is configured to pivot into engagement with an indentation in response to applied centrifugal force of the rotating connecting member.

11. The motion restrictor of claim 10, wherein the centrifugal force value causing the pawl to pivot into engagement with an indentation corresponds to the threshold rateof movement between the helmet and the harness.

12. The motion restrictor of claim 8 wherein the threshold rate of movement between the helmet and the harness corresponds to one of a force applied to the helmet or acceleration experienced by the helmet that can cause injury to the user of the helmet.

13. The motion restrictor of claim 9, wherein the coupling between the centrifugal brake and the second elongated member comprises an affixing fastener and the coupling between the centrifugal brake and the first elongated member comprises intermeshed teeth that convert linear motion to rotational motion.

14. The motion restrictor of claim 9, wherein the coupling between the centrifugal brake and the first and second elongated members comprises intermeshed teeth that convert linear motion to rotational motion.

15. The motion restrictor of claim 8, wherein the centrifugal brake assembly comprises a base member having a planar surface, a recess formed within the planar surface having teeth on the recess outer periphery, an elongated connecting arm in the recess affixed with a pin and rotatable about the pin, a slot formed on the elongate end of the connecting arm, and a sliding member provided in the slot and slidable past the connecting arm outer periphery.

16. The motion restrictor of claim 15, wherein the coupling between the brake assembly and the first elongated member rotates the connecting member in response to movement between the first and second elongated members and wherein the sliding member is configured to slide into engagement with teeth in the recess in response to applied centrifugal force of the rotating connecting arm.

17. A method of restricting motion of a protective helmet to be worn by a user comprising:

linking the helmet to a portion of the user's torso by a coupling that comprises a first member and a second member, the first member affixed on one end to the helmet and slidingly coupled to the second member on the other end, the second member having an end connected to a portion of the user's torso and the opposite end slidingly coupled to the first member on the other end; and coupling a centrifugal brake assembly between the first member and the second member, wherein the centrifugal brake assembly includes a connecting element having a member responsive to sliding movement between the first and second members, the member extendable by a threshold centrifugal force into engagement with a profiled surface, wherein the engagement prevents connecting element rotation and arrests sliding movement between the first and second member.

18. The method of claim 17 wherein the threshold centrifugal force corresponds to a force applied to the helmet or an acceleration experienced by the helmet that could injure the helmet user.

19. The method of claim 17, wherein the centrifugal brake assembly is affixed to the second member and rotatingly coupled to the first member.

20. The method of claim 17, wherein the centrifugal brake assembly is rotatingly coupled to the first and second member.

21. The method of claim 17, wherein the member comprises a pawl pivotingly connected to an elongate end of the connecting element.

22. The method of claim 17, wherein the member comprises a sliding element provided in a slot formed on an elongate end of the connecting element.

* * * * *